US008875356B2

(12) United States Patent
Zerfas et al.

(10) Patent No.: US 8,875,356 B2
(45) Date of Patent: Nov. 4, 2014

(54) MECHANICAL AND ADHESIVE BASED RECLOSABLE FASTENERS

(71) Applicants: Paul Anthony Zerfas, Verona, WI (US); Leonard Scarola, Cary, NC (US); David Chris Masterson, Grove City, OH (US); Mark R. Alten, Lancaster, OH (US); Jeffrey James Boyce, Grove City, OH (US); Colleen Marie Henry, Dublin, OH (US); Kelly J. Jenkins, Hilliard, OH (US); Vincent Daniel McGinniss, Columbus, OH (US)

(72) Inventors: Paul Anthony Zerfas, Verona, WI (US); Leonard Scarola, Cary, NC (US); David Chris Masterson, Grove City, OH (US); Mark R. Alten, Lancaster, OH (US); Jeffrey James Boyce, Grove City, OH (US); Colleen Marie Henry, Dublin, OH (US); Kelly J. Jenkins, Hilliard, OH (US); Vincent Daniel McGinniss, Columbus, OH (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 1 day.

(21) Appl. No.: 13/644,527

(22) Filed: Oct. 4, 2012

(65) Prior Publication Data

US 2013/0091667 A1 Apr. 18, 2013

Related U.S. Application Data

(60) Provisional application No. 61/544,223, filed on Oct. 6, 2011.

(51) Int. Cl.

| | |
|---|---|
| ***A44B 18/00*** | (2006.01) |
| ***B65D 33/16*** | (2006.01) |
| ***B65D 33/25*** | (2006.01) |

(52) U.S. Cl.

CPC ..... *A44B 18/008* (2013.01); *A44B 18/0007* (2013.01); *B65D 33/2541* (2013.01); *B65D 2313/02* (2013.01)

USPC ..... 24/448; 24/114.6; 24/304; 24/449

(58) Field of Classification Search

USPC ..... 24/114.6, 304, 448, 449, 602; 383/210, 383/210.1, 211

See application file for complete search history.

(56) References Cited

U.S. PATENT DOCUMENTS

| | | | | |
|---|---|---|---|---|
| 2,035,675 | A | 3/1936 | Sipe | |
| 2,048,544 | A | 7/1936 | Fritts | |
| 2,074,368 | A | 3/1937 | Corner | |
| 2,144,755 | A * | 1/1939 | Freedman | 24/594.11 |

(Continued)

FOREIGN PATENT DOCUMENTS

| | | |
|---|---|---|
| CH | 287845 A | 12/1952 |
| EP | 305123 A1 | 3/1989 |

(Continued)

OTHER PUBLICATIONS

International Search Report, date of mailing Jan. 17, 2013 for PCT/US2012/058866 (3 pgs.).

(Continued)

*Primary Examiner* — Robert J Sandy
*Assistant Examiner* — David Upchurch
(74) *Attorney, Agent, or Firm* — Fitch, Even, Tabin & Flannery LLP

(57) ABSTRACT

A hybrid reclosable fastener with both mechanical mating and adhesive reclosable mating elements and a method of forming the hybrid reclosable fastener is described herein. Mechanical mating elements include mating portions having cooperating coupling parts configured to provide mechanical mating along with adhesive mating elements including an adhesive material formed on the cooperating coupling parts configured to provide an adhesive mating.

17 Claims, 26 Drawing Sheets

(56) References Cited

U.S. PATENT DOCUMENTS 2,197,968 A 4/1940 De Mattia
2,499,898 A * 3/1950 Anderson ..... 24/442
2,558,367 A 6/1951 Madsen
2,658,246 A 11/1953 Mahler
2,772,469 A 12/1956 Staller et al.
2,777,181 A 1/1957 Morner
2,794,227 A 6/1957 Dorman
2,797,463 A 7/1957 Dorman et al.
2,871,539 A 2/1959 Swan
3,112,496 A 12/1963 Dritz
3,173,184 A 3/1965 Ausnit
3,192,589 A * 7/1965 Pearson ..... 24/452
3,217,871 A 11/1965 Lee
3,239,904 A 3/1966 Ausnit
3,270,408 A 9/1966 Nealis
3,339,606 A * 9/1967 Kugler ..... 383/63
3,353,663 A 11/1967 Kayser et al.
3,386,846 A 6/1968 Lones
3,408,705 A 11/1968 Kayser et al.
3,425,469 A 2/1969 Ausnit
3,440,696 A 4/1969 Staller
3,471,903 A 10/1969 Northrup et al.
3,557,413 A 1/1971 Engle
3,808,648 A 5/1974 Billarant et al.
3,849,840 A 11/1974 Yamada et al.
3,869,764 A 3/1975 Umezu
3,918,131 A 11/1975 Ausnit
3,991,801 A 11/1976 Ausnit
4,046,408 A 9/1977 Ausnit
4,061,820 A 12/1977 Magid et al.
4,101,625 A 7/1978 Haley
4,216,257 A 8/1980 Schams et al.
4,290,174 A 9/1981 Kalleberg
4,322,875 A 4/1982 Brown et al.
4,512,479 A 4/1985 Hain et al.
4,519,095 A 5/1985 Clayton
4,556,595 A 12/1985 Ochi
4,601,694 A 7/1986 Ausnit
4,670,960 A * 6/1987 Provost ..... 29/415
4,672,721 A * 6/1987 Provost ..... 24/442
4,673,383 A * 6/1987 Bentsen ..... 493/381
4,706,297 A 11/1987 Ausnit
4,787,880 A 11/1988 Ausnit
4,835,835 A 6/1989 Gould
4,858,286 A 8/1989 Siegel
4,875,259 A 10/1989 Appeldorn
4,878,763 A 11/1989 Ausnit
4,937,040 A 6/1990 Holcomb et al.
4,946,527 A 8/1990 Battrell
4,947,525 A * 8/1990 Van Erden ..... 24/304
4,971,454 A 11/1990 Branson et al.
4,982,064 A 1/1991 Hartman et al.
5,035,517 A 7/1991 Edelman
5,040,275 A 8/1991 Eckhardt et al.
5,067,210 A 11/1991 Keyaki
5,073,457 A 12/1991 Blackwell
5,077,870 A 1/1992 Melbye et al.
5,088,164 A * 2/1992 Wilson et al. ..... 24/584.1
5,097,570 A 3/1992 Gershenson
5,110,649 A 5/1992 Morse et al.
5,113,555 A 5/1992 Wilson et al.
5,141,790 A 8/1992 Calhoun et al.
5,149,573 A 9/1992 Kobe et al.
5,167,454 A 12/1992 Woods et al.
5,173,344 A 12/1992 Hughes
5,209,574 A 5/1993 Tilman
5,211,481 A 5/1993 Tilman
5,212,853 A 5/1993 Kaneko
5,212,855 A 5/1993 McGanty
5,221,276 A * 6/1993 Battrell ..... 604/389
5,238,306 A 8/1993 Heintz et al.
5,242,646 A 9/1993 Torigoe et al.
5,250,253 A 10/1993 Battrell
5,272,794 A 12/1993 Hamatani et al.
5,286,781 A 2/1994 Gotoh et al.
5,290,842 A 3/1994 Sasaki et al.
5,360,270 A 11/1994 Appeldorn et al.
5,459,193 A 10/1995 Anderson et al.
5,474,382 A 12/1995 May
5,489,252 A * 2/1996 May ..... 383/210.1
5,492,411 A 2/1996 May
5,537,720 A 7/1996 Takizawa et al.
5,566,429 A 10/1996 Martinez et al.
5,575,747 A * 11/1996 Dais et al. ..... 493/213
5,579,562 A 12/1996 Hattori et al.
5,586,372 A 12/1996 Eguchi et al.
5,598,610 A 2/1997 Torigoe et al.
5,611,122 A 3/1997 Torigoe et al.
5,639,811 A 6/1997 Plamthottam et al.
5,655,273 A 8/1997 Tomic et al.
5,657,516 A * 8/1997 Berg et al. ..... 24/452
5,660,479 A 8/1997 May et al.
5,662,983 A 9/1997 Stark
5,664,303 A 9/1997 Johnson
5,664,953 A 9/1997 Reylek
5,671,511 A 9/1997 Hattori et al.
5,671,512 A 9/1997 Hattori et al.
5,691,021 A 11/1997 Kobe
5,761,775 A 6/1998 Legome et al.
5,783,012 A 7/1998 Porchia et al.
5,794,315 A 8/1998 Crabtree et al.
5,832,145 A * 11/1998 Dais et al. ..... 383/211
5,851,071 A 12/1998 Arnell
5,867,876 A 2/1999 Petersen
5,871,607 A 2/1999 Hamilton et al.
5,924,795 A 7/1999 Thompson et al.
5,930,877 A * 8/1999 Thorpe et al. ..... 24/585.12
5,941,643 A 8/1999 Linkiewicz
5,952,420 A 9/1999 Senkus et al.
5,954,433 A 9/1999 Yeager
5,955,160 A 9/1999 Tanaka et al.
5,972,448 A 10/1999 Frisk et al.
6,017,412 A 1/2000 Van Erden et al.
6,033,113 A 3/2000 Anderson
6,112,377 A 9/2000 Wilson
6,159,596 A * 12/2000 Calhoun et al. ..... 428/343
6,162,040 A 12/2000 Clune
6,179,625 B1 1/2001 Davis et al.
6,185,796 B1 2/2001 Ausnit
6,210,038 B1 4/2001 Tomic
6,223,401 B1 5/2001 D'Sa et al.
6,312,828 B1 11/2001 Akao
6,358,576 B1 3/2002 Adur et al.
6,393,673 B1 * 5/2002 Kourtidis et al. ..... 24/304
6,486,253 B1 11/2002 Gilmer et al.
6,487,759 B1 12/2002 Akeno et al.
6,499,878 B1 12/2002 Dobreski et al.
6,541,098 B2 4/2003 Venkatasanthanam et al.
6,602,580 B1 8/2003 Hamilton et al.
6,630,220 B1 10/2003 Veiga
6,632,522 B1 10/2003 Hyde et al.
6,660,366 B1 12/2003 Simpson
6,687,962 B2 * 2/2004 Clarner et al. ..... 24/452
6,713,152 B2 3/2004 Chen et al.
6,723,407 B2 4/2004 Dollase et al.
6,841,241 B2 1/2005 Luhmann et al.
6,852,422 B2 2/2005 Kendall et al.
6,979,379 B2 12/2005 White, II
7,018,496 B1 3/2006 George et al.
7,165,888 B2 1/2007 Rodick
7,168,214 B2 1/2007 Wall
7,171,730 B2 * 2/2007 Kasai ..... 24/30.5 R
7,316,101 B1 * 1/2008 Nguyen et al. ..... 53/408
7,340,807 B2 3/2008 Dais et al.
7,407,496 B2 * 8/2008 Petersen ..... 604/390
7,424,796 B2 9/2008 Shepard et al.
7,836,564 B2 * 11/2010 Barvosa-Carter et al. ..... 24/442
7,895,717 B2 3/2011 Tuma
2001/0001164 A1 5/2001 Van Erden
2001/0051253 A1 12/2001 Tai et al.
2002/0052281 A1 5/2002 Van Erden
2002/0056176 A1 5/2002 Murasaki
2002/0124357 A1 9/2002 Dudek et al.
2002/0133129 A1 9/2002 Arias et al.

(56) References Cited

U.S. PATENT DOCUMENTS

| | | | | |
|---|---|---|---|---|
| 2002/0173414 | A1 | 11/2002 | Leighton | |
| 2002/0184740 | A1 | 12/2002 | Meager | |
| 2003/0031386 | A1 | 2/2003 | Shepard et al. | |
| 2003/0051320 | A1 | 3/2003 | Fagan et al. | |
| 2003/0095727 | A1 | 5/2003 | Leighton | |
| 2003/0183497 | A1 | 10/2003 | Johnston et al. | |
| 2003/0184991 | A1 | 10/2003 | Johnston et al. | |
| 2003/0190451 | A1 | 10/2003 | Baker et al. | |
| 2003/0224144 | A1 | 12/2003 | King et al. | |
| 2004/0001927 | A1 | 1/2004 | Moran et al. | |
| 2004/0064922 | A1 | 4/2004 | Fernando | |
| 2004/0074069 | A1* | 4/2004 | Browne et al. | 24/442 |
| 2004/0097630 | A1 | 5/2004 | Whitman et al. | |
| 2004/0106693 | A1 | 6/2004 | Kauffman et al. | |
| 2004/0118579 | A1 | 6/2004 | McCutcheon et al. | |
| 2004/0161178 | A1 | 8/2004 | Olechowski | |
| 2004/0180197 | A1 | 9/2004 | Everaerts et al. | |
| 2004/0191438 | A1 | 9/2004 | Cosentino et al. | |
| 2004/0219336 | A1 | 11/2004 | Sano | |
| 2005/0212182 | A1 | 9/2005 | Yokoyama et al. | |
| 2005/0286810 | A1* | 12/2005 | Sprague et al. | 383/61.2 |
| 2006/0173124 | A1 | 8/2006 | Paul et al. | |
| 2006/0228057 | A1 | 10/2006 | Newrones et al. | |
| 2007/0092167 | A1* | 4/2007 | Tilman et al. | 383/63 |
| 2008/0035173 | A1* | 2/2008 | Tuman et al. | 134/9 |
| 2008/0093776 | A1 | 4/2008 | Williams | |
| 2008/0140043 | A1* | 6/2008 | Mandzsu et al. | 604/391 |
| 2008/0241502 | A1 | 10/2008 | Giselbrecht et al. | |
| 2008/0271298 | A1 | 11/2008 | Meager et al. | |
| 2008/0273819 | A1 | 11/2008 | Hannon et al. | |
| 2009/0053445 | A1 | 2/2009 | Trent et al. | |
| 2009/0279813 | A1* | 11/2009 | Pokusa et al. | 383/211 |
| 2009/0297071 | A1 | 12/2009 | Koenigkramer et al. | |
| 2009/0304309 | A1 | 12/2009 | Hayes et al. | |
| 2010/0086240 | A1 | 4/2010 | Yeager | |
| 2010/0146746 | A1* | 6/2010 | Autterson | 24/444 |
| 2010/0257822 | A1* | 10/2010 | Bowling | 53/476 |
| 2010/0260543 | A1 | 10/2010 | Cameron et al. | |
| 2011/0210163 | A1* | 9/2011 | Clark et al. | 229/120.05 |
| 2011/0211778 | A1* | 9/2011 | Zerfas et al. | 383/211 |
| 2011/0213092 | A1* | 9/2011 | Boyce et al. | 525/310 |

FOREIGN PATENT DOCUMENTS

| | | | |
|---|---|---|---|
| EP | 325528 | A1 | 7/1989 |
| EP | 1733640 | A1 | 12/2006 |
| EP | 1905584 | A2 | 4/2008 |
| FR | 2264209 | A1 | 10/1975 |
| WO | WO9409279 | A1 | 4/1994 |
| WO | WO0187566 | A1 | 11/2001 |
| WO | WO03067099 | A1 | 8/2003 |
| WO | WO2005030600 | A1 | 4/2005 |
| WO | WO2006127739 | A2 | 11/2006 |
| WO | WO2007027423 | A2 | 3/2007 |
| WO | WO2007063351 | A2 | 6/2007 |
| WO | WO2008151508 | A1 | 12/2008 |
| WO | WO2010030412 | A1 | 3/2010 |

OTHER PUBLICATIONS

International Preliminary Report on Patentability and Written Opinion of the International Searching Authority, date of issuance Apr. 8, 2014 for PCT/US2012/058866 (6 pg.).

* cited by examiner

MECHANICAL AND ADHESIVE BASED RECLOSABLE FASTENERS

CROSS-REFERENCE TO RELATED APPLICATION

This application claims benefit of U.S. Provisional Application No. 61/544,223, filed Oct. 6, 2011, which is hereby incorporated herein by reference in its entirety.

FIELD

This disclosure relates generally to reclosable fasteners and, in particular, to reclosable fasteners having both a mechanical component and an adhesive component.

BACKGROUND

Several types of closures or fasteners are available that permit repeated opening and reclosing of the fastener. They may be commonly used on packages and bags, but may also be used on other substrates such as clothing, boxes, shoes, diapers, pockets, or folders to suggest but a few examples. For example, it is common to use mechanical reclosable fasteners, such as slider zippers, clips, tabs, interlocking strips, and the like. These mechanical closures can be bulky, complex structures that require separate molding and fabrication steps prior to being joined to the various substrates. If used on flexible packages, the film rolls or other packaging materials incorporating such fasteners can be unwieldy and difficult to handle due to the added bulk from the fastener(s). Such fasteners can also add significant material and production costs to a package. In applications in which an air-tight or hermetic seal is desired, prior mechanical-based fasteners may also not form a sufficient airtight seal upon closure. When in a closed position, slider zippers can have an undesirable small air channel or gap due to bridging of interlocking flanges between an end-stop and the slider. Other mechanical interlocking fasteners may also have small air gaps and other spaces between the opposing portions that may allow air passage over time. When used on flexible packaging, mechanical fasteners can be applied in form, fill, and seal operations; however, such a process can require complex manufacturing steps to apply, interconnect, and align the features of each structure. For at least these reasons, mechanical reclosable fasteners can add undue complexity, cost, and expense into the manufacture of such packages while providing less than desirable reclosable capabilities in many applications.

Adhesive-based reclosable fasteners provide one alternative to the mechanical fasteners discussed above. Adhesive-based fasteners, however, present other challenges in both the manufacture, formation, and repeated use thereof. For example, pressure-sensitive adhesives (PSAs) may be useful as a one-time or permanent fastener; however, common PSA materials generally have relatively high tack levels rendering the adhesive as an undesired reclosable fastener. Tack is a property of an adhesive material that generally enables the material to form a bond with the surface of another material upon brief or light pressure. Tack is often considered as a quick stick, an initial adhesion, or a quick grab characteristic of a material. The high tack levels of many PSAs may, in some cases, result in shortcomings when attempting to use the PSAs as a reclosable fastener because the high tack generally does not permit the fastener to be easily opened and reclosed multiple times because the adhesive tends to be too sticky. The high tack levels of many PSAs may also cause shortcomings when attempting to run PSA coated materials on common processing equipment such as: blocking where the material does not unwind freely from a roll due to unacceptable back-side adhesion; picking where there is undesirable and unintended transfer of adhesive material to equipment surfaces, such as rollers, mandrels and filling tubes; poor tracking, such as the inability of the material to stay in proper alignment as it passes through the packaging machine; and jamming where the material is unable to slide over equipment surfaces and binds up.

If used as a fastener in situations where debris and contamination may come into contact with the adhesive, the resealability of the PSA fastener may tend to diminish. For example, if the fastener comes into contact with a crumbly product (i.e., a cookie, cracker, and the like), a shredded product (i.e., shredded cheese and the like), a fatty product, or a product with fine particulate, then the high tack levels of many PSAs may cause the crumbs or shreds to stick to the fastener, which reduces the effectiveness of the adhesive to form a fastener due to contamination of the PSA surface from the debris. A PSA fastener that is contaminated with product (examples noted above) will generally not form an adequate seal because the crumbs or other debris that are adhered to the PSA generally do not allow the PSA to adhere to the other side of the fastener in a repeated fashion.

On the other hand, lower tack PSAs generate other concerns when formed into a reclosable fastener. By its very nature, a lower tack adhesive is designed to have a reduced ability to stick to other surfaces, and lower tack adhesives can be difficult to adhere to a substrate surface due to its low tack properties. Thus, fasteners created with low tack PSAs may result in delamination of the PSA from the substrate surface upon opening or separating of the fastener. Even with low tack PSA adhesives, in some cases, fouling off the fastener with moisture, lipids, and very fine particulate can still result in a fastener that does not reseal effectively. Thus, when used as a fastener, low tack adhesive based reclosable fasteners may still present problems when a consumer attempts to reclose the fastener if it has come into contact with fatty or lipid containing foods, powdery foods, foods with topical seasonings, roast and ground coffee, shredded cheese, and powdered beverages, to suggest a few examples, because these materials can still reduce the effectiveness of the fastener.

DETAILED DESCRIPTION

Figure 1:
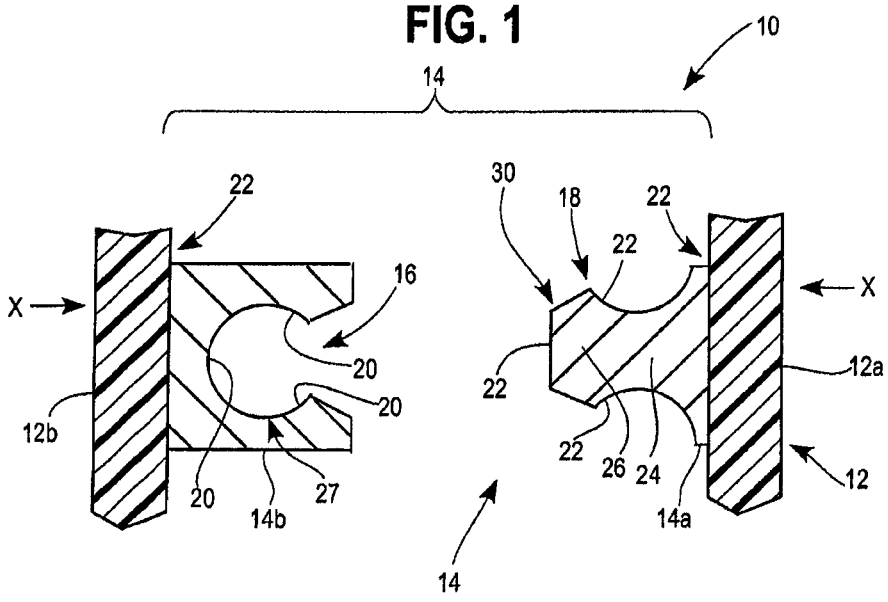
FIG. 1 is a cross-sectional view of an exemplary adhesive-based reclosable fastener.

A hybrid reclosable fastener with both mechanical and adhesive reclosable mating elements in the same fastener component and methods of forming thereof are described herein. In one aspect, the fastener can be supported upon opposing substrate portions and includes fastening elements that have both mechanical and adhesive characteristics that can be coupled or mated together to form a reclosable seal. In another aspect, the mechanical mating elements include interlocking or mating portions that can have cooperating coupling parts configured to provide mechanical locking or mating of the cooperating coupling parts when coupled together. In yet another aspect, the adhesive mating elements include adhesive contacting portions of the cooperating coupling parts that are formed of an adhesive, cohesive, or other bonding material, such as an acrylic composition, that can form a bond between the contacting portions and is configured to also provide an adhesive bond of the cooperating coupling parts when coupled together. In yet another aspect, the adhesive mating elements include a configuration that exhibits a shear force and, in some cases, both a shear force and a peel force upon opening of the fastener. The fastener may include both interference and/or non-interference mechanical mating elements. The hybrid combination of both mechanical and adhesive mating elements in the same fastener component provides an enhanced reclosable seal over fasteners having separate mechanical and adhesive seals. The fasteners herein may also have an increased surface area available for adhesive mating to the structures and shapes of the mechanical mating elements.

By one approach, at least the adhesive contacting portions and, in some cases, the entire cooperating coupling parts themselves can be formed from an adhesive or a material with self-bonding capabilities. By one approach, the adhesive is an acrylic adhesive having an energy-curable acrylic oligomer, a tack control component and, optionally, at least one elastomeric component. In one approach, the acrylic adhesive can be cured while in contact with a flexible and perhaps transparent mold to form the reclosable fastener where the cooperating coupling parts define mating undercut surfaces forming the mechanical mating portion of the fastener. Thus, portions of fastener, and in some cases, the mating undercut surfaces can mechanically mate or interlock and, at the same time, also adhesively bond together the opposing substrate surfaces by providing an interference engagement and an adhesive bond therebetween. In one instance, the cooperating coupling parts can define mating undercut surfaces with a male portion on one mating portion and a female portion on the other mating portion or, in another instance, a tongue on one mating portion and a complementary groove on the other mating portion. In other instances, the cooperating coupling parts can have a three-dimensional geometry where, in one approach, the interlocking portions can be a multi-directional mating configuration or, in another approach, the mating portions can be a uni-directional locking configuration. Other mating orientations of the cooperating coupling parts may also be employed.

Since at least portions thereof and, in some cases, the entire cooperating coupling parts are formed from an adhesive, the cooperating coupling parts also exhibit adhesive bonding properties, such that the cooperating coupling parts of the hybrid reclosable fastener can also adhesively bond to each other upon contact in addition to forming the mechanical mating or coupling between the cooperating coupling parts. In one approach, an acrylic adhesive is employed that exhibits relatively low-tack properties that provides for the cooperating coupling parts to also releasably bond to the opposing parts of the fastener. Furthermore, the reclosable fastener is bonded to a substrate with a sufficient bond strength such that the opposing layers of the mating portions do not delaminate from the substrate when the opposing mating portions are separated from each other even when the adhesive used to form the mating portions has a low tack property. In some approaches, while the fastener may have a relatively high cohesive bond strength between the opposing mating portions to form a good bond therebetween, it also has an adhesive formulation that has a relatively low tack when exposed to an unlike surface, such as surfaces of crumbs, lint, particulate, or the like. As discussed herein, one example of a bondable or adhesive material suitable for the fasteners herein is an energy curable acrylic adhesive; however, other adhesives and bondable materials may also be suitable for the fasteners as needed for a particular application.

So configured and in some approaches, the hybrid reclosable fastener having the mechanical mating properties and adhesive mating properties allows for repeated resealing of the opposing mating portions with consistent peel strengths even when contaminated with debris. This resealable characteristic is not diminished even by exposure or contact with foods or materials that tend to diminish the adhesive bonding strength of other adhesive fasteners, such as fine particulate of less than about 150 microns, materials with high moisture, and/or materials with a fatty content. Thus, the reclosable fastener herein is effective to reseal opposing faces of a substrate repeatedly even after contact with powdery materials such as roast and ground coffee, powdered beverages, shredded cheese, liquids, fatty products, and other fine powders.

In other aspects, there are effective material characteristics that provide an interlocking/mechanical adhesive reclosable fastener system. One characteristic is the adhesive component ratio (ACR) of the acrylic composition components [i.e., (wt % acrylate oligomer)/(wt % elastomer+wt % tack control agent)]. The ACR is discussed in more detail below. Other possible characteristics may be an effective surface energy parameter that controls the bond strength interface between the substrate 12 and the mating portions 14. Surface energy is discussed in more detail below.

Other possible characteristics include tensile strength and percent elongation that allow the interlocking process to occur with enough strength for sealing and, at the same time, sufficient toughness for unlocking many times as the package is sealed and unsealed by the consumer. This also requires that the PSA has good adhesion to the mechanical profile materials and is compatible mechanically with the percent elongation and tensile strengths of the profile materials during the closure and resealing operations.

In one aspect, the configuration of the cooperating coupling parts is shaped to define the mating undercut features, which aids in the ability to provide this unique resealability of the adhesive contacting portions even when contaminated with debris. In one approach, the undercut features define at least some of the adhesive contacting portions of the fastener. These adhesive contacting portions are surfaces underneath an upper protruding surface or enlarged portion of the coupling parts. Thus, the adhesive contacting portions are not generally directly exposed or directly visible from an upper surface of the reclosable fastener. As a result, the protruding or enlarged portions of the coupling parts protect the adhesive contacting portions from debris and can maintain a surface underneath the undercut portion substantially free from the potential of being contaminated. Thus, even if the exposed or upper surface areas of the fastener are contaminated due to exposure to various contaminants, the protected adhesive contacting portions will still provide mechanical mating or interlocking as well as still provide a sufficient bond of the adhesive on these protected undercut portions thereof because these portions tend to remain substantially free of contamination. Therefore, the combination of a mechanical and cohesive bond provide for enhanced sealing and enhanced air tightness over just a mechanical closure on its own.

As discussed further below, the opposing layers of the hybrid fasteners herein can be applied on a variety of substrates such as packaging materials, including, for example, film, paperboard or other paper products, cardboard, foil, metal, laminates, flexible, rigid, or semi-rigid plastic products, or combinations thereof to name a few. Similarly, these materials can be used to create a variety of packages or containers, including, for example, flexible pouches or bags, cartons or boxes, sleeves, and clamshell packages, to name a few. However, the hybrid fasteners may also be used on many other substrates that may use a fastener that is reclosable. Other suitable examples include using the hybrid fasteners herein on disposable diapers, as fasteners on articles like athletic shoes, fasteners for jacket front openings, fasteners for pocket closures, or other types of clothing apparel, fasteners for office or school supplies such as folders and portfolios, closures on camping tents or back packs, as repositionable labels or markers for posters and maps for educational supplies/classroom instructional materials, fasteners for arts and crafts such as scrap-booking, repositionable fasteners for board game pieces, or repositionable strapping for bundling goods during shipping that are easy to apply and remove.

Figure 2:
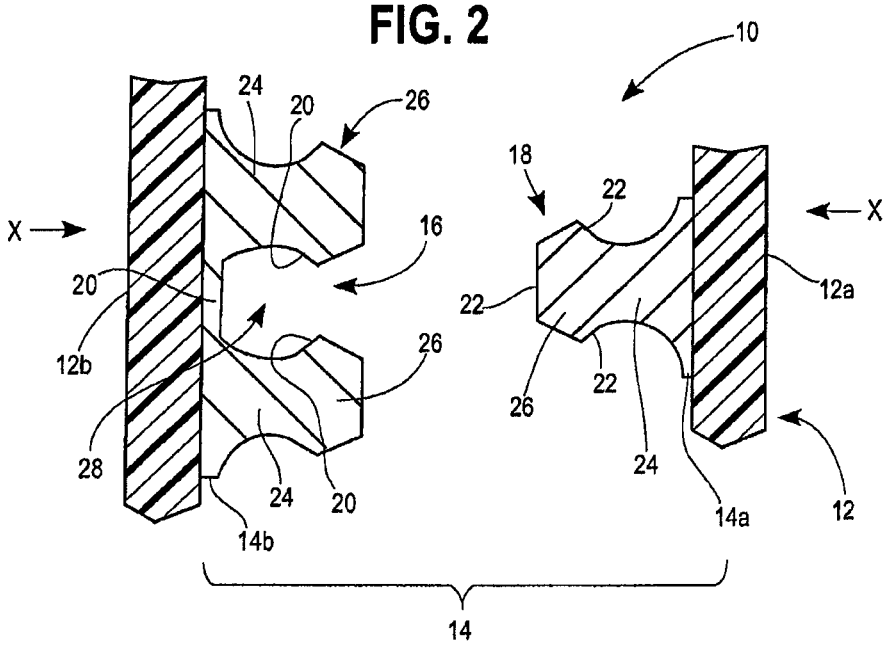
FIG. 2 is a cross-sectional view of another exemplary adhesive-based reclosable fastener.

Turning to more of the specifics, FIGS. 1 and 2 show generalized approaches of exemplary hybrid reclosable fastener 10 including both mechanical mating and adhesive-based mating elements within the same fastener component. The fastener 10 generally includes a substrate 12 having opposing substrate portions 12*a* and 12*b* thereof for supporting the reclosable fastener 10. The fastener 10 has opposing interlocking or mating portions 14 with interlocking or mating portions 14*a* and 14*b* on each of the opposing substrate portions 12*a* and 12*b*, respectively. The mating portions 14*a* and 14*b* are configured and at least partially formulated out of a material to provide both mechanical mating and adhesive mating of the fastener 10 and, at the same time, permit repeated opening and reclosing of the fastener with consistent bond strengths even when contaminated.

In one approach, for the mechanical mating component, the mating portions 14*a*, 14*b* define cooperating coupling parts 16 and 18 that are configured to couple together in a mating relationship to mechanically couple, mate and/or lock the portions 14*a* and 14*b* together when coupled due to an interference therebetween. For the adhesive mating component, the cooperating coupling parts 16 and 18 also include one or more adhesive contacting portions 20 and 22 thereof that are positioned to contact each other when the cooperating coupling parts 16 and 18 are coupled together so that the contacting portions 20 and 22 form a cohesive bond therebetween. FIGS. 1 and 2 show exemplary adhesive contact portions 20 and 22 on each of the coupling parts 16 and 18, but these contacting portions are only exemplary and the locations and positions may vary depending on the specific configuration of the fastener.

In one approach as generally shown in FIG. 1, one of the coupling parts 18 defines a protruding stem or post 24 with an enlarged outer segment or bulbous end 26 at a distal end 30 thereof. It may be appreciated that the post 24 may be a discrete member or the cross-section of a longitudinal rib extending the length of the fastener. The opposing coupling part 16 may then define a cooperating pocket or receptacle 27 for mating reception of the post 24 and bulbous end 26 of the other coupling part 18. The receptacle 27 may be a discrete pocket or a groove that extends the length of the fastener.

When so coupled, the various adhesive contacting portions will adhesively bond together in various adhesive bonding surfaces that may be in line with or may be transverse to the substrate portions 12*a* and 12*b*.

In another approach as generally shown in FIG. 2, each of the opposing coupling parts 16 and 18 may define similar protruding stems or posts 24 having the enlarged end portion 26. In this approach, one or both of the coupling parts may include a plurality of adjacent posts 24 to define a space or cavity 28 therebetween for receiving the enlarged portion 26 and post 24 of the cooperating coupling part on the opposite mating portion. As with the previous approach, when coupled, the various adhesive contacting portions will adhesively bond together in various adhesive bonding surfaces.

So configured, the fastener 10 has a three-dimensional shape or geometry and at least portions thereof are formulated out of an adhesive-based material to provide an enhanced bond and enhanced air tightness between the opposing portions 12*a* and 12*b* even when the fastener is contaminated with debris, moisture, fats, and the like. The shape and formulation is also effective to provide for repeated opening and reclosing with little to no drop in the bond strength between the opposing portions even when so contaminated. Prior mechanical fasteners tend to show a difficulty in mating when contaminated with debris and have limited ability to form a hermetic seal. Prior adhesive fasteners can result in a diminished ability to form a bond when contaminated with fine particulate, moisture, and lipids. The fasteners herein have a unique configuration to protect the adhesive contacting portions 20 and 22 from debris to provide not only a mechanical mating but also an adhesive bonding as well. The generalized cooperating coupling parts 16 and 18 of the mating portions 14*a* and 14*b* shown in FIGS. 1 and 2 may take on any number of shapes and configurations that are appropriate to provide mating of the cooperating coupling parts 16 and 18 when coupled together. Examples of some suitable shapes are described further below.

The hybrid mechanical mating elements and the adhesive mating elements of the fastener 10 combine to provide a first or initial bonding or peel force between the opposing substrate portions 12*a* and 12*b* of about 80 to about 900 grams per linear inch (gpli). These hybrid mating elements also provide up to at least five subsequent peel forces between the opposing substrate portions 12*a* and 12*b* of about 60 to about 900 gpli. Even when contaminated (as discussed in more detail below), the hybrid mating elements still provides an enhanced bond having a peel force of about 60 to about 900 gpli. In addition to the bonding and peel forces, the hybrid mechanical mating elements and the adhesive mating elements herein also combine to provide an improved level of air-tightness when compared to a fastener of substantially identical geometry made from a non-cohesive material. While not wishing to be limited by theory, it is believed that such enhanced bond is due, in part, to the unique combination of mechanical mating features, undercut mating surfaces, adhesive mating features, protection of the adhesive bonding portions from contamination, and/or the formulation of materials used to form the fastener.

As will be discussed in more detail with more specific forms of the fastener below, there are at least two general ways or methods that the cooperating coupling parts can be coupled together as a reclosable fastener depending on how the mating portions are constructed and aligned. By one approach, the mating portions may be configured for uni-directional alignment or alignment in a single linear direction. In another approach, the portions are configured for a multi-directional alignment or alignment in multiple directions.

In one instance, an exemplary uni-directional alignment can include cooperating coupling parts having a tongue on one mating portion and a complimentary groove on the other mating portion defined by longitudinal ribs on the fastener portions. Uni-directional alignment of the coupling parts provides for the coupling parts to be based on parallel mating ribs. To close the fastener, the uni-directionally aligned coupling parts can be brought together with the mating ribs on each opposing strip roughly parallel to one another in order to reseal successfully.

Alternatively, the multi-directional alignment can include cooperating coupling parts having a plurality of spaced mating protrusions on each of the mating portions, such as a plurality of spaced male parts and a plurality of spaced female parts. This arrangement provides for a multi-directional coupling or mating, where the male part is inserted into any of the cavities formed in between the adjacent female parts. The multi-directionally aligned coupling parts can be resealed regardless of orientation of the opposing substrate portions. Many other mating feature geometries are possible with either approach. These will be better described below in reference to the Figures.

It will be appreciated that various features and components are described with respect to the exemplary hybrid fasteners described below and shown in FIGS. 1-16; however, the various components and elements described with one fastener geometry are not specific to any particular construction or form of fastener and may be included as appropriate in any combination with any of the exemplary fasteners provided herein. Of course, other variations and types of fasteners incorporating the features of the hybrid fasteners may also be possible. Each of the exemplary hybrid fasteners herein are constructed, in one approach, entirely out of an adhesive material so that the outer surfaces of the fastener geometry exhibit a level of tack or level of stickiness. Exemplary hybrid fasteners are shown in FIGS. 3-16.

Figure 3:
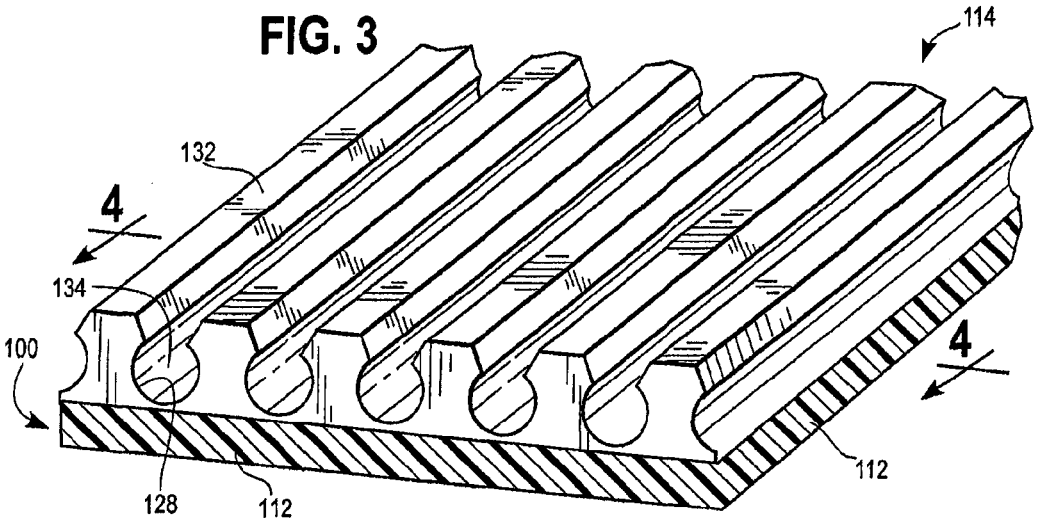
FIG. 3 is a perspective view of a first embodiment of an adhesive-based reclosable fastener shown in a uni-directional alignment.
Figure 4:
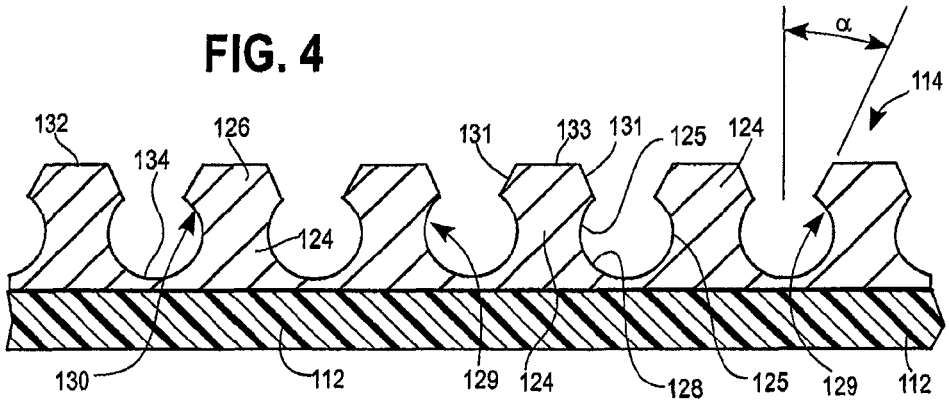
FIG. 4 is a cross-sectional view of the first embodiment of the adhesive-based reclosable fastener of FIG. 3 taken along line 4-4.
Figure 5:
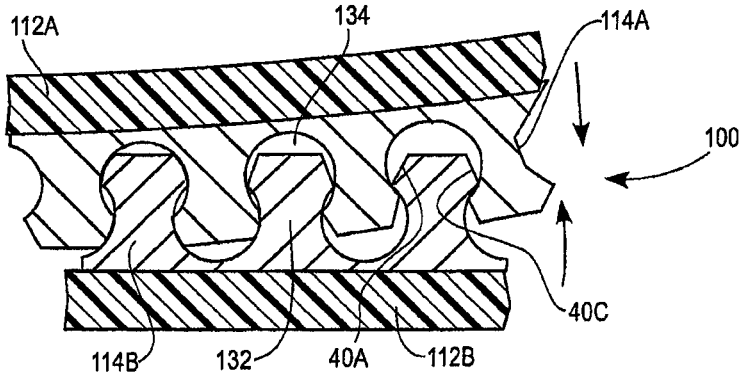
FIG. 5 is a cross-sectional view of two opposing interlocking portions containing the adhesive-based fastener of FIG. 3 interlocking in a uni-directional alignment.
Figure 6:
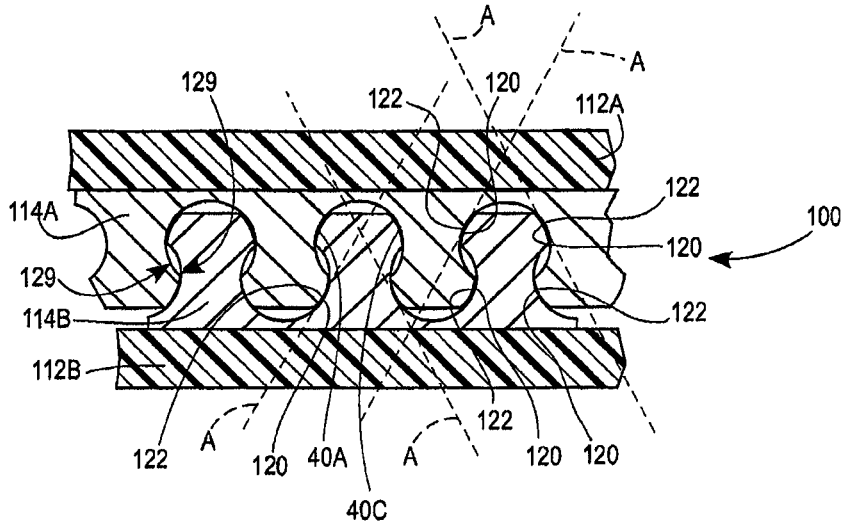
FIG. 6 is a cross-sectional view of the two opposing interlocking portions of FIG. 5 shown in an interlocked orientation.

By one approach and turning to FIGS. 3-6, an exemplary uni-directional locking or mating fastener 100 is provided utilizing a tongue and groove-type assembly with a tongue 132 and groove 134 provided on each of the opposing mating portions 114. The tongue 132 may be a post 124 with an enlarged end segment 126 at a distal end 130 thereof that extends along the entire length of the fasteners' mating portions 114 as generally shown in FIG. 3. There are at least two or more generally parallel and adjacent rows of tongue portions 132 extending along the length of the mating portions 114. These adjacent rows of tongue portions 132 also define the groove 134 therebetween that is configured to receive the tongue 132 from the opposing mating portion as generally shown in FIGS. 5 and 6 when coupled together.

More particularly, the groove 134 may be defined between two adjacent rows of tongue portions 132 where a cavity 128 is formed by facing sidewalls 125 of the immediate adjacent pair of posts 124. By one approach, the cavity 128 that forms the groove 134 may define a circular pocket or receptacle configured to receive the tongue 132 therein as shown in FIGS. 5 and 6. To seal the fastener together or close opposing mating portions, the tongue 132 on one mating portion is aligned with and pressed into the groove 134 of the opposing mating portion when coupled together. Because the tongue 132 and groove 134 each extends along the length of the mating portion in a generally parallel fashion, each is generally aligned with the other in order to receive the tongue in the groove and mechanically couple or mate the two together. Thus, the tongue and groove assembly provides a single direction or uni-directional mechanical mating in which the two mating portions can be coupled together once the rows of opposing tongue and groove portions are aligned.

As shown in more detail in the cross-sectional view of FIG. 4, this approach shows that the enlarged end section 126 may define an outer or top flat surface 133 at the distal end 130 of the post 124 with inclined side portions 131 that extend outwardly and away from the flat surface 133 beyond the width of the lower post portion 124 to define the enlarged end section 126. In one aspect, the side slanting portions 131 may have an angle of inclination α that is about 20 to about 40 degrees from a vertical axis extending through the groove 134, in some cases, about 20 to about 30 degrees, and in other cases, about 25 degrees; however, other appropriate inclinations can be provided as needed for a particular application. The walls 125 of the post 124 curve inwardly and define a concave surface extending away from a lower end of the inclined side portion 131. The curved walls 125 define the concave pocket or the cavity 128 of the groove 134 in this approach. The enlarged end section 126 also defines an undercut mating surface 129 that is configured to mechanically couple or mate the mating portions together when coupled as shown in FIGS. 5 and 6.

FIGS. 5 and 6 show the fastener 10 being coupled and in a coupled state to show both the mechanical mating of the cooperating coupling parts due to one or more interferences of the undercut mating surfaces 129 as well as the adhesive bonding due to the engagement of the various contacting adhesive mating surfaces 120 and 122. As best shown in FIG. 6, the undercut mating surfaces 129 couple or mate the portions together due to an interference thereof along an axial direction of the fastener posts 124. The hybrid fastener 100 also has pairs of contacting adhesive contact portions 120 and 122 formed from an adhesive material to form an adhesive bond therebetween. As shown, the adhesive contacting portions 120 and 122 are generally formed in an adhesive bonding surface A extending transverse or inclined to a plane of the opposing substrate portions 112*a* and 112*b*. The surface can be linear, curved, or flat. With multiple adhesive contacting portions 120 and 122, then more than one adhesive bonding surface A may be present. With adhesive contacting portions 120 and 122 formed on opposite sides of the tongue and groove as shown in FIG. 6, the coupled fastener has at least two intersecting bonding planes A that extend in different directions that may aid, in some cases, to form a more robust sealing bond between the coupling parts because the adhesive bonding is at an angle relative to the substrate. As the post 124 may be entirely formed form the adhesive material, the post and enlarged end 126 thereof may be resilient or flexible to allow flexing and/or compression thereof to allow the tongue 132 to be received within the groove 134.

The repeating pattern of the mating portions may occur at a frequency of about 12 to about 500 per linear inch, and in some cases, about 12 to about 200 per linear inch. For example, the patterns of the fasteners in FIGS. 3-6 have a center-to-center distance between adjacent parallel ridges of about 0.002 to about 0.067 inches, or about 12 to 500 ridges per linear inch.

Figure 7:
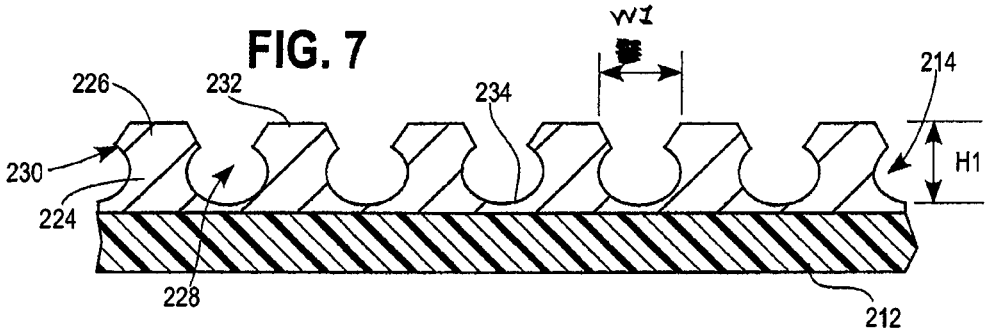
FIG. 7 is a cross-sectional view of a second embodiment of an adhesive-based reclosable fastener shown in a uni-directional alignment.

The mating portion 214 of FIG. 7 has a similar tongue and groove-like arrangement as the components of FIGS. 3-6; however, the posts 224 in this approach are modified to provide a greater frequency of cooperating coupling parts per linear inch. The more closely spaced coupling parts in this approach (i.e., high frequency) tends to result in a higher cohesive bond strength or self-adhesion due to more surface area in contact between coupling parts. Due to the higher frequency of cooperating coupling parts, the parallel rows of posts 224 and grooves 228 in this approach are positioned slightly closer together than in the previous embodiment such that a smaller groove 234 is formed. Additionally, an aspect ratio of the height H1 of the post 224 plus the enlarged end segment 226 relative to width W1 of the groove 234 at its widest point is larger in this approach. For example, the aspect ratio of the cooperating coupling parts in FIG. 7 may be about 0.03 inches high over 0.02 inches wide or about 1.5 while the aspect ratio of the fastener in FIGS. 3-6 may be about 0.05 inches over 0.04 inches or about 1.25.

Figure 8:
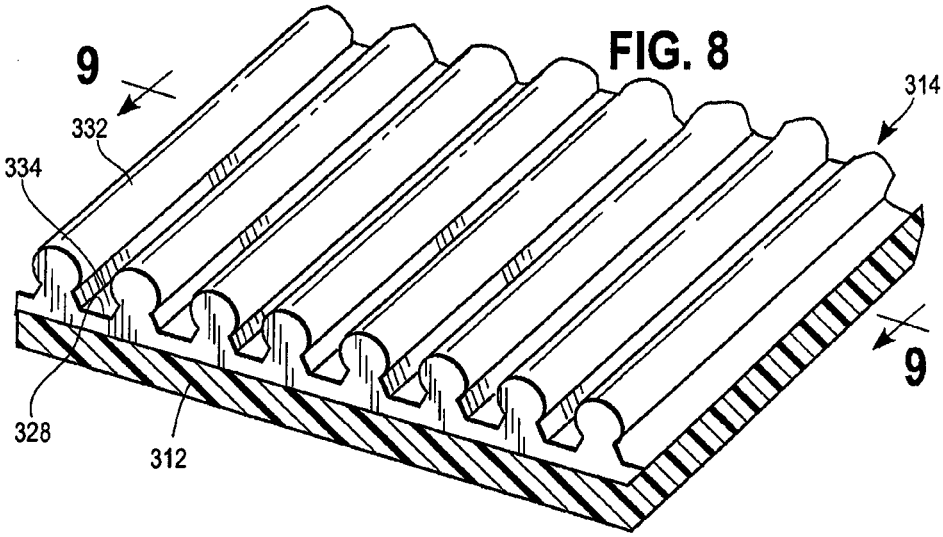
FIG. 8 is a perspective view of a third embodiment of an adhesive-based reclosable fastener shown in a uni-directional alignment.
Figure 9:
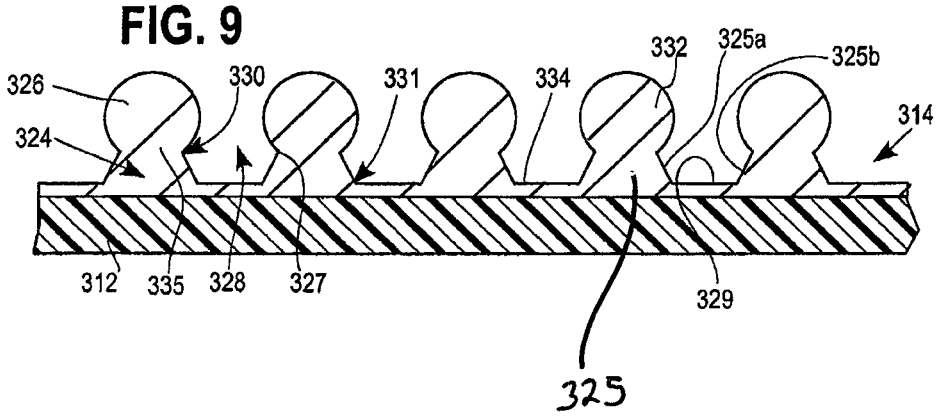
FIG. 9 is a cross-sectional view of the third embodiment of the adhesive-based reclosable fastener of FIG. 8 taken along line 9-9.

By yet another approach, alternative uni-directional mating portion 314 is shown in FIGS. 8 and 9. In this approach, the mating portion 314 defines a tongue 332 and groove 334 arrangement similar to the previous approaches; however, the post and enlarged portion forming the tongue and the cavity forming the groove are modified relative to the other approaches. Here, an enlarged portion 326 at a distal end 330 of the tongue post 324 is curved or rounded in a convex fashion. The curvature of the enlarged portion 326 curves out and away from a body 325 of the post 324 starting at an intermediate location point 327 thereof to form a globe or ball-shaped outer end of the tongue 332. The post body 325 also has side walls that taper outwardly and away from intermediate body point 327 toward the substrate 312. Facing portions of the curved enlarged portion 326 and facing portions of the tapered body 325 form a cavity 328 of the groove 334. As with the other approaches, the cavity 328 is configured for receipt of a cooperating enlarged portion 326 from an opposing substrate 312 for the mechanical mating of the fastener. In this approach, the groove 334 has the cavity 328 that is generally not round as in the previous embodiments, but rather has a somewhat hexagonal shape formed from the facing tapered walls 325*a* and 325*b* of the body 325 and a generally flat bottom wall 329. As with the other uni-directional approaches, the tongue and groove extend in generally parallel rows along the entire length of the mating portion 314 as generally shown in FIG. 8.

Figure 10:
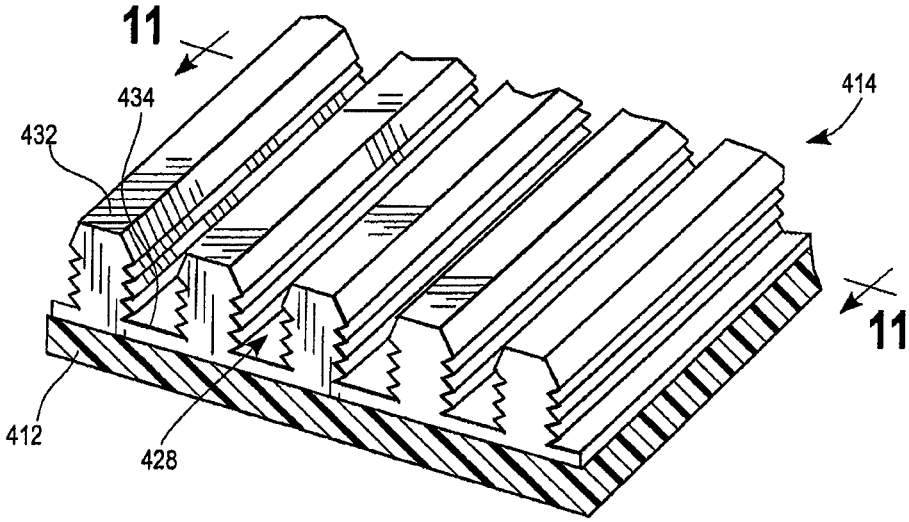
FIG. 10 is a perspective view of a fourth embodiment of an adhesive-based reclosable fastener shown in a uni-directional alignment.
Figure 11:
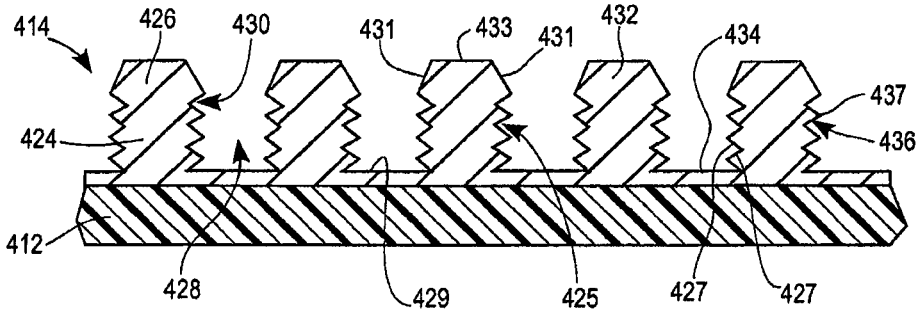
FIG. 11 is a cross-sectional view of the fourth embodiment of the adhesive-based reclosable fastener of FIG. 10 taken along line 11-11.

By still another approach, an alternative uni-directional mating portion 414 is shown in FIGS. 10 and 11. In this approach, the tongue and groove assembly defines multiple mating portions to provide for a plurality of mechanical and adhesive mating sites. It is believed that this approach may provide an even higher bonding strength due to the V-shaped edges, which provides more mechanical mating and more contact for adhesive bonding. In this approach, the mating portion 414 includes a tongue 432 and groove 434 that extend along the length of the mating portion 414 in generally parallel rows to form a uni-directional fastener. This fastener includes a plurality of adjacent ridges 424. Each ridge 424 defines the tongue 432 and a cavity 428 between adjacent rows of ridges 424 defines the groove 434.

In this embodiment, outer side walls 425 of the ridge 424 define at least one and, in some cases, a plurality of indentations or teeth 436 along its side edges. By one approach, these teeth 436 are a plurality of V-shaped microprotrusions that extend outwardly into the cavity 328 from the side surface of the ridge 424. As shown, each side wall 425 includes at least one and, in some cases, a plurality of adjacent teeth. Three are shown, but more or less may be used as needed. In this approach, the teeth are configured in a V-shape where each tooth is defined by facing ridge walls 427 that taper away from each other into the cavity 428. Other shapes, sizes, and numbers of the teeth may also be appropriate as needed for a particular application.

In this approach, the distal end 430 of the ridge 432 includes an outer cap 426 with no teeth 436 having side walls 431 that taper inwardly toward each other similar to the approach shown in FIG. 3. The tapered shape of the end cap 426 aids in inserting the tongue 432 into the groove 434. When coupled together so that a tongue 432 is inserted into the groove 434 of an opposing mating portion 414, each of the teeth 436 of one tongue mechanically couple or mate with adjacent teeth from the adjacent tongue to provide multiple mating points as generally due to multiple interferences 429 as the facing tooth walls 427 abut each other. In addition, each of the tooth walls 427 can contact another facing tooth wall on the adjacent post to form multiple adhesive contact portions along a variety of adhesive contacting planes that extend at an angle $\alpha$ to the opposing substrate surfaces.

The cap 426 may also have a relatively flat upper end surface 433 with the tapered side walls 431. This flat end wall 433 may also form yet another adhesive contacting portion with the base 429 of the cavity 434 to form an adhesive contacting plane that is generally parallel with the substrate portions 412. The end cap 426, in this approach, generally does not extend beyond outer peaks or intersection points 437 of the tooth walls 427 of the ridge teeth 436.

Turning now to FIGS. 12-16, examples of multi-directional mating portions of the fastener are shown. As opposed to the uni-directional mating portions that include a plurality of generally parallel rows of cooperating coupling parts along the length of the mating portions, the multi-directional mating portions include a plurality of discrete and spaced cooperating coupling parts that define a three-dimensional matrix of protrusion-like members that form mechanical and adhesive mating by mating the two opposing portions together in more than one direction and, in some cases, any direction. The multi-directional mating portions are advantageous because they allow the opposing substrate portions to be fastened together in multiple alignment.

Figure 12:
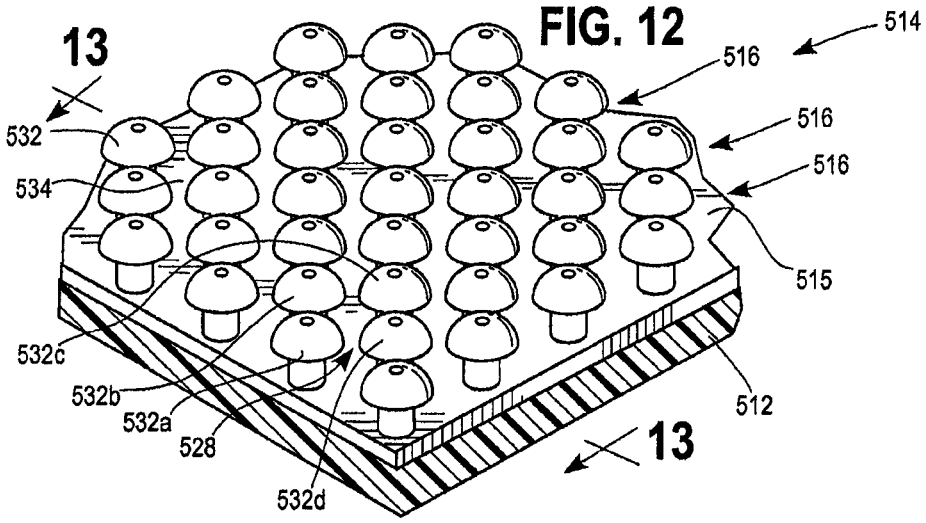
FIG. 12 is a perspective view of a fifth embodiment of an adhesive-based reclosable fastener shown in a multi-directional alignment.
Figure 13:
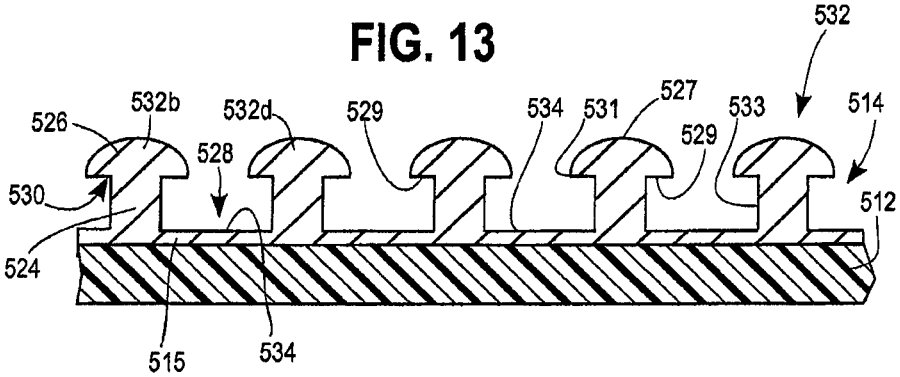
FIG. 13 is a cross-sectional view of the fifth embodiment of the adhesive-based reclosable fastener of FIG. 12 taken along line 13-13.
Figure 14:
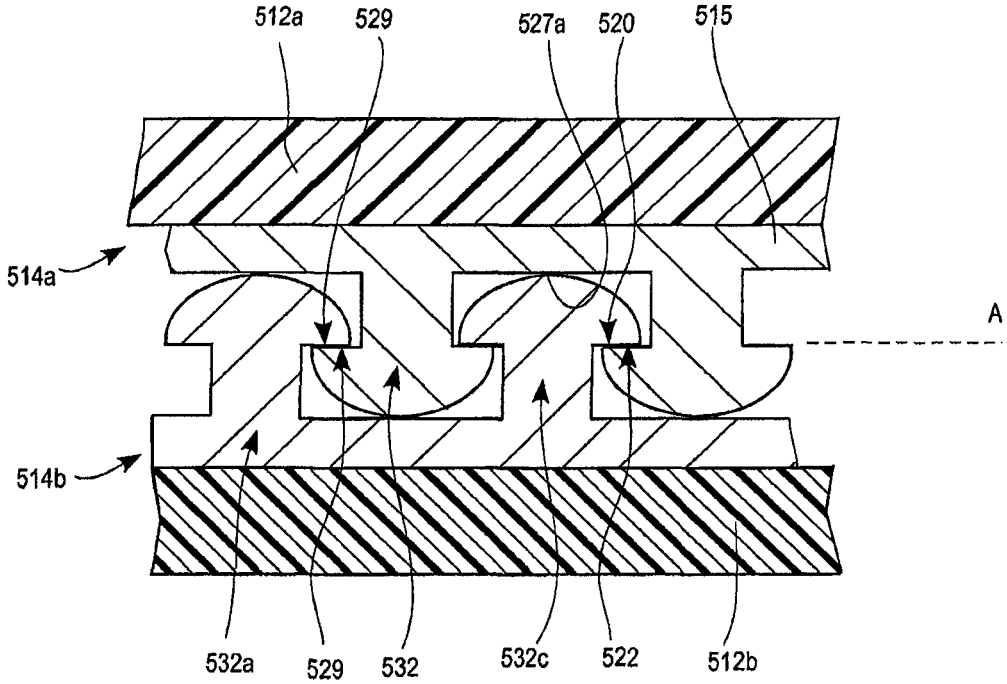
FIG. 14 is a cross-sectional view of two opposing interlocking portions containing the adhesive-based fastener of FIG. 12 in an interlocked orientation.

In one approach, a multi-directional mating portion 514 can be provided with a plurality of spaced protrusions 532 as generally shown in FIGS. 12-14. The protrusions 532 may be disposed on a base 515 in a series of rows 516 in which the protrusions 532 are spaced apart within the rows, but are also oriented in a staggered or offset alignment with respect to the protrusions in adjacent rows, as generally shown in the perspective view of FIG. 12. In a reclosable fastener including the multi-directional mating portion 514, one approach would use the portion 514 for each of the opposing mating portions 14.

As best shown in the cross-sectional view of FIG. 13, each protrusion 532 may include a post 524 extending outwardly from the base 515 and an outer cap or enlarged portion 526 at a distal end 530 thereof such that the protrusion 532 is generally in the form of a mushroom-shape member. The outer cap or enlarged portion 526 can have any appropriate shape and, in the instance shown in FIG. 13, includes a convex or rounded outer wall 527 defining an enlarged dome that extends beyond the outer walls of the post 524. As the cap 526 extends beyond the post 524, the bottom of the cap 526 defines a ledge 529 due to the outer wall 527 terminating at a lower edge 531 that is spaced a distance beyond a side wall 533 of the post 524. Each protrusion 532 forms one of the cooperating coupling parts of the mating portion 514.

The plurality of spaced protrusions 532 arranged adjacent one another define a cavity or well 528 between adjacent posts 532*a*, 532*b*, 532*c*, and 532*d* for example to provide a pocket 534 for receipt of a post 532 from an opposing mating portion 514. As shown in the perspective view of FIG. 12, the pocket 534 is generally formed from the four adjacent posts 532*a-d*. To close a fastener using the mating portions 514, the coupling parts can be brought together and pressed together such that a post 532 from one mating portion 514 couples and mates with four adjacent posts from an opposing portion 514 as generally shown in the cross-sectional view in FIG. 14 (in this cross-sectional view, only posts 532*a* and 532*c* are shown). In this approach, undercut portions 529 of the protrusions 532 are formed by the ledges 529 of the upper caps 526. These undercut portions, when coupled to the opposing mating portion, form a mechanical mating due to the ledges 529 abutting and forming an interference with each other along an axial direction of the post 524 as generally shown in FIG. 14. In some approaches, the contacting of the ledges 529 also define adhesive contacting portions 520 and 522 where the ledge 529 from one cap is adhesively bonded to the ledge 529 on another cap along an adhesive bonding plane A. In other approaches, a top or apex 527*a* of the dome wall 527 may also contact the base 515 to form an adhesive contacting portion therebetween along an alternative adhesive bonding surface. In yet other approaches, adhesive bonding may occur between the ledges as well as the cap/base interface.

Figure 14A:
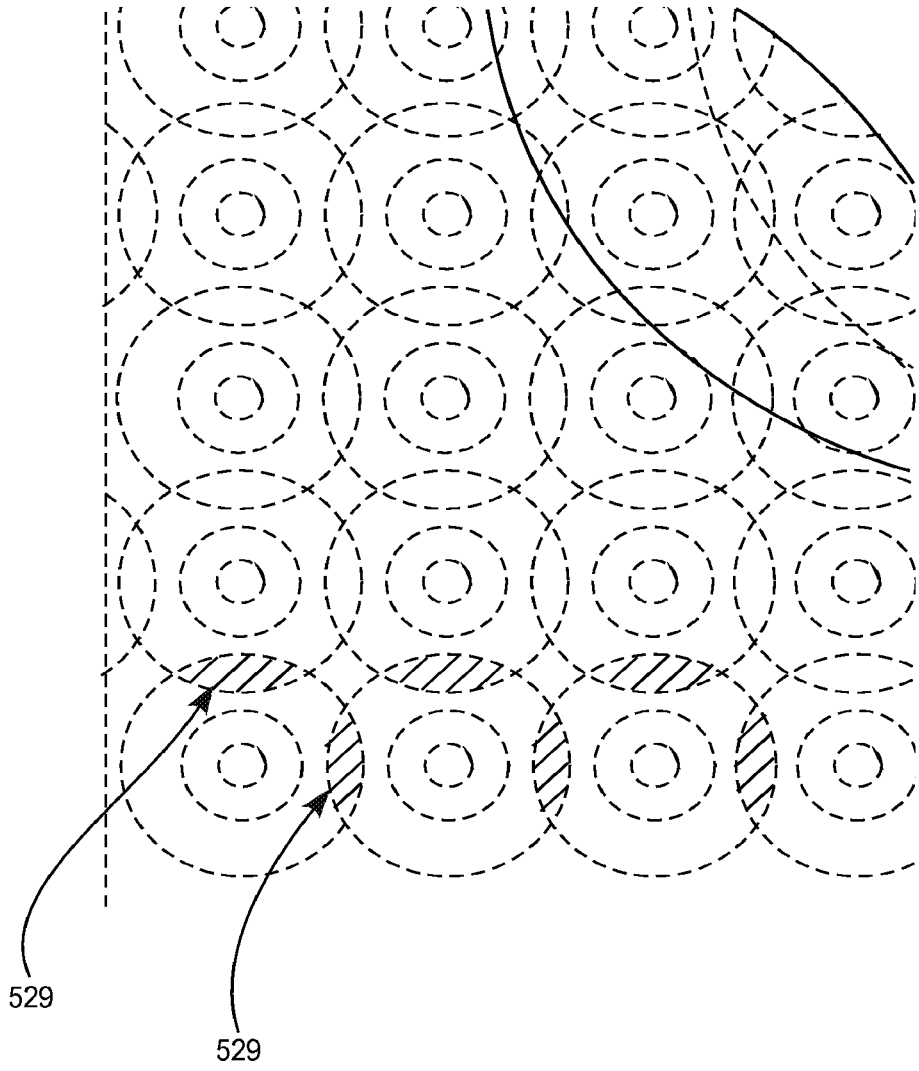
FIG. 14A is a top view of superimposed images of interlocked fasteners showing an exemplary degree of overlap between adjacent fastener portions.

By one approach, about 12 to about 500 protrusions per lineal inch (about 138 to about 250,000 per square inch) may be helpful to achieve desired bonding strengths. By one approach, the spacing and amount of overlapping contacting portions between adjacent protrusions may be selected so there is a sufficient degree of mechanical interference and contacting surface area for adhesive bonding. FIG. 14A provides an example of such overlapping surface area. The dome-shape aids in inserting the protruding post and dome into the opposing cavity. As shown in FIG. 14A, areas of overlap 529 represent an exemplary degree of mechanical interference and the contacting surface areas between the coupling parts of the fastener on each of the opposing portions.

Figure 15:
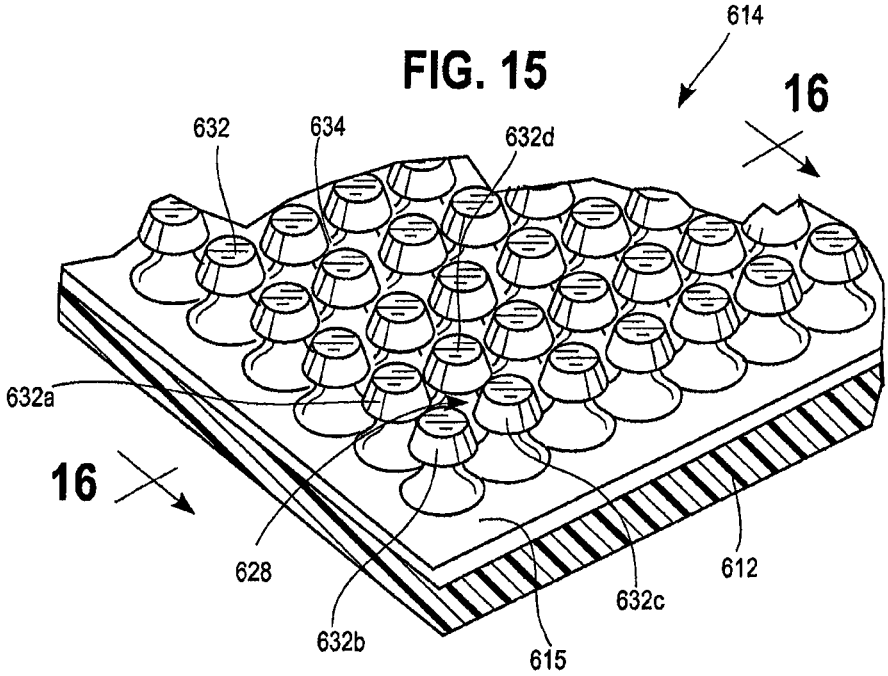
FIG. 15 is a perspective view of a sixth embodiment of an adhesive-based reclosable fastener shown in a multi-directional alignment.
Figure 16:
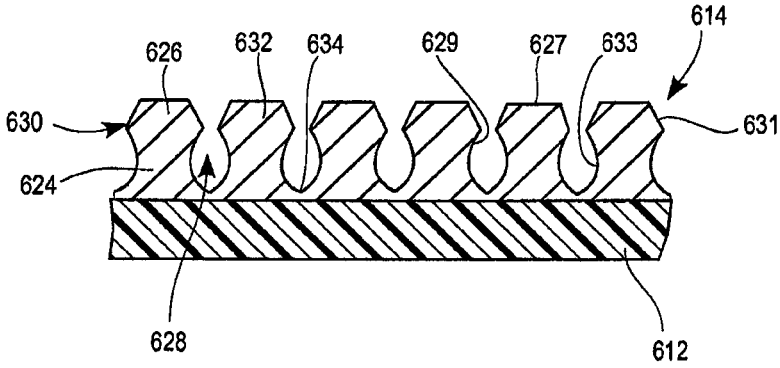
FIG. 16 is a cross-sectional view of the sixth embodiment of the adhesive-based reclosable fastener of FIG. 15 taken along line 16-16.

Another embodiment of a multi-directional mating portion 614 is shown in FIGS. 15-16. In this approach, the mating portion 614 includes a similar matrix of protrusions 632 spaced in parallel rows about a base 615. If desired, the spacing of the protrusions may be closer than those in the previous approach. However, the spacing may vary as needed for a particular approach.

In this approach, each protrusion 632 has a generally frusto-conical shape including a lower post portion 624 with an inwardly curved or concave outer wall 633 and an upper enlarged portion 626 having an inwardly tapering annular side wall 631 with a generally flat top wall 627. The inward taper of the side wall 631 may range from about 20 to about 30 degrees and, in some cases, about 25 degrees from a vertical axis extending through the post portion 624. Each protrusion 632 may form one of the cooperating coupling parts of one of the mating portions 614.

As with the other approach, the plurality of spaced protrusions 632 arranged adjacent one another define a cavity or well 628 between adjacent protrusions 632*a*, 632*b*, 632*c*, and 632*d* to provide a pocket 634 for receipt of a post 632 from an opposing mating portion 614. As shown in the perspective view of FIG. 15, the pocket 634 is generally formed from the four adjacent posts 632*a-d*. This pocket 628 forms another of the cooperating coupling parts of the fastener. In this approach, less contact area may be desirable for certain applications where very low opening force is required. Not being off-set may simplify manufacturing. A tapered head may be easier to extract from a mold compared to a mushroom shaped head.

To close a fastener using the mating portions 614, the coupling parts can be brought together and pressed together such that a post 632 from one mating portion 614 couples and mates with four adjacent posts from an opposing portion 614. In this approach, undercut portions 629 of the protrusions 632 are formed by the concave side wall 633 of the post portion 624 (FIG. 16). These undercut portions, when coupled to the opposing mating portion, form a mechanical mating due to the upper curved portions thereof abutting and forming an interference with each other along an axis of the post. In some approaches, the contacting of the upper curved portions also define adhesive contacting portions where the curved walls 633 from one protrusion is adhesively bonded to the curved wall 633 or the tapered wall 631 on another adjacent wall along an adhesive bonding surface A. In other approaches, the top or apex 627 of the upper portion 626 may also contact the base 615 to form an adhesive contacting portion therebetween along an alternative adhesive bonding surface. In yet other approaches, adhesive bonding may occur between other locations along adjacent protrusions.

Once the cooperating coupling parts are brought together and coupled, regardless of whether mating is done in a unidirectional or multi-directional manner, the mechanically and adhesively mated coupling parts can have a bond or peel force between the mating portions that must be overcome upon separating or opening the cooperating coupling parts. Generally this bond or peel force may be a combined bond due to mechanical mating elements and adhesive mating elements. In one aspect, the mating portions may have an overall bonding strength of peel force from about 60 gpli to about 900 gpli that generally includes a mechanical mating portion and an adhesive bonding portion.

By one approach, at least portions thereof and, in some cases, the entire mating portions themselves are formed from a unique cohesive material that allows for repeated bonding and separation thereof with consistent levels of bonding strength and peel forces due to the adhesive bonding components of the fastener. By one approach, the cohesive is an acrylic adhesive that has a composition effective to maintain a consistent bonding and peel force as well as to minimize adhesion to undesired surfaces and still function, at the same time, as an effective reclosable fastener that does not delaminate from the substrate surface that it is bonded to. That is, the adhesive-based fastener and substrate have a unique formulation and construction to achieve select tack and peel values of the mating portions so that the opposing substrate portions of the fastener can be opened and closed multiple times, but at the same time, not delaminate from the opposing substrate panels.

In one approach, each of the mating portions includes or is formed entirely out of an energy cured pressure sensitive adhesive (PSA) exhibiting cohesive properties and low tack, but, despite the low tack, still form a strong bond to the substrate forming the opposing substrate panels. As generally understood, a cohesive-based material typically adheres more readily to like materials (i.e., self-adhesion) rather than to non-like materials. Suitable adhesive materials used herein generally exhibit a relatively low tack to undesired surfaces, but at the same time still exhibit a good bond strength to desired surfaces (such as no delaminating from the opposing panels), and relatively good cohesive or self adhesion bond strength to like surfaces to close the fastener, but still permit the substrate to be openable or peelable by hand. The selected adhesive-based materials also permit debonding or peeling from such like materials so that the adhesive layers may be repeatedly peeled apart without substantial damage to the adhesive, the mating features and geometries, and/or any underlying substrate material. When the adhesive material is debonded or peeled apart, the mating portions formed from the adhesive material have sufficient internal integrity and generally peel apart at an adhesive bonding interface substantially cleanly without substantial material picking, stringiness, delamination from the substrate material, and/or other substantial disfigurations of the material (i.e., globbing, pilling, etc.). In addition, upon peeling apart, the cooperating coupling parts remain intact and are generally not permanently deformed, destroyed, and/or fractured.

Advantageously and in some approaches, the adhesive bonding component of the hybrid fasteners herein maintain a peel adhesion where opposing adhesive-based coupling parts contact each other with an average initial peel adhesion greater than about 80 grams per linear inch (gpli) and, in some cases, between about 200 gpli and about 900 gpli. Moreover, in some instances, the adhesive-based fasteners retain greater than about 200 gpli and/or at least about 30% to about 200% of the average initial peel adhesion after five repeated seal and unseal operations.

In another aspect, a substrate having the adhesive-based fastener disposed thereon is also constructed so that a primary bond of the energy-cured, adhesive-based mating portions to the substrate is generally greater than the opening peel strength between the layers of the fastener itself. In this manner, the mating portions generally remain adhered to the substrate and do not pick, string, or delaminate from the substrate when the closure is opened by a consumer and the fastener is peeled open. For example and in one approach, the primary bond or peel strength of the adhesive mating portions to the substrate is greater than about 900 gpli and is capable of withstanding multiple peel and re-seal cycles without detachment from the substrate material. In addition, the adhesive forming the mating portions is sufficiently cured so that it is capable of withstanding more than 100 double rubs with methyl ethyl ketone (MEK) solvent without visible damage to the adhesive.

In one approach, the opposing mating portions 14*a* and 14*b* including the cooperating coupling parts 16 and 18, as generally shown in FIGS. 1 and 2, can each be formed entirely out of adhesive materials described herein. Thus, the entire mating portions 14*a* and 14*b* and cooperating coupling parts thereof have at least outer surfaces of an adhesive material exhibiting a surface with self-adhering characteristics. In another approach, only the outer surfaces of and, in some cases, only the adhesive contacting portions thereof are formed from the adhesive materials described herein.

For example, the opposing mating portions 14*a* and 14*b* may be formed from a liquid adhesive mixture that may be heated and applied to the substrate material at a warm temperature, such as at about 160° F. (71° C.), but can be in the range of about 86° F. (30° C.) to about 190° F. (88° C.). After application, the applied coating mixture, which can contain an added photoinitiator, can be contacted with a flexible and transparent patterned mold while also exposed to UV treatment or electron beam treatment to cure (polymerize) the adhesive material and to form the solid adhesive-based fastener 10 into the various shapes of the mating portions on the substrate. By one approach, the adhesive or coating mixture does not contain any or any substantial levels of solvent that needs to be removed and may be easily applied to the substrate on high speed coating and printing lines.

In one aspect, the adhesive material for constructing the mating portions, the cooperating coupling parts, and/or the adhesive contacting portions thereof may include specific blends of an energy-curable acrylic oligomer and a tack control agent. In other approaches, the reclosable adhesive-based fastener may include specific blends of at least one energy-curable acrylic oligomer, at least one tack control agent, and at least one elastomer (rubber) component. Examples of suitable adhesive materials may be those described in U.S. application Ser. No. 13/035,399, which is incorporated herein it its entirety. This adhesive demonstrates a unique and surprising ability to form a reclosable fastener with high self-adhesion or cohesive bonding and, at the same time, low tack to non-like surfaces. Other types of adhesives may also be used as needed for a particular application.

The first component of the acrylic adhesive may be one or more energy-curable acrylate or acrylic oligomers. For instance, the energy-curable acrylic oligomer may be an acrylic or methacrylic acid ester having multiple reactive or functional groups (i.e., acrylic or methacrylic oligomers). In general, a functional group includes one energy reactive site. By one approach, energy reactive sites are most commonly carbon-carbon double bonds conjugated to another unsaturated site such as an ester carbonyl group. By one approach, the energy-curable acrylic oligomer is an acrylic or methacrylic acid ester of a multifunctional alcohol, which means the oligomer has more than one acrylated or methacrylated hydroxyl group on a hydrocarbon backbone of the oligomer. By one approach, the adhesive may include about 1% to about 90% by weight of the energy-curable acrylic oligomers and with functionalities of about 1.2 to about 6.0. In another approach, the energy-curable acrylic oligomers may have a functionality of about 2.0 to about 3.0. In other approaches, the adhesive may include about 20% to about 70% by weight (in some cases, about 33% to 60% by weight) of the acrylic oligomers.

In one form, the multifunctional energy-curable acrylic acid ester is an acrylic acid ester of a vegetable oil having a reactive functionality of 2.0 or greater. In another aspect, the energy-curable acrylic oligomer can comprise an epoxidized soybean oil acrylate. In general, the amount of the energy-curable acrylic oligomers used, based on a preferred adhesive component ratio (ACR) (to be discussed herein), can impact the properties of the final adhesive. For instance, where the amount of the energy-curable acrylic oligomer is too low, based on the preferred ACR, the cure rate of the final adhesive is too slow. On the other hand, where the amount of the energy-curable acrylic oligomer is too high, based on the preferred ACR, the final adhesive may be adequately cured, but can have inadequate self adhesion properties to seal and reseal.

The second component of the adhesive is a tack control agent. By one approach, the acrylic adhesive may include about 1% to about 65% by weight of the tack control agent. In another approach, the tack control agent can be present in amounts from about 20% to about 65%. The tack control agent can include a tackifying resin or a curable polymer/monomer combination that when cured can produce the desired levels of tack and self-adhering properties appropriate for the reclosable fastener 10. In one aspect, the tack control agent can comprise an aliphatic urethane acrylated oligomer. Many other types of tack control agents suitable for energy-curable PSA adhesives may also be used in the reclosable adhesive system.

An optional third component of the adhesive is at least one elastomeric or rubber component. By one approach, the elastomeric component may include at least one curable acrylated (i.e., acrylic modified) or methacrylated esters of a hydroxy-terminated elastomeric polymer (i.e., an elastomeric polyol). This elastomeric component can include acrylic-modified polybutadiene, a saturated polybutadiene and/or a flexible polyurethane. In one aspect, a methacrylated polybutadiene can be provided. The elastomeric material can be provided in amounts of about 0% to about 20% when used in the adhesive. In one aspect, the elastomeric material is provided in amounts of about 5% to about 15%. Satisfactory adhesives can be made with the desired low tack, resealable properties as described herein without the elastomer component; however, it is believed that the elastomeric component aids in achieving an optimal coating performance. The optimal adhesive performance can be defined by properties such as self-adhesion, tack, viscosity, durability, and cure rate, just to name a few. The elastomeric component is useful for adjusting peel strength properties, substrate adhesion strength, increasing flexibility, viscosity control, and cure rate modulation.

To achieve the desired peel, tack, and bond to the substrate material as described herein, it was determined that the amounts of the three adhesive components fall within a specific adhesive component ratio (i.e., ACR) of the acrylate oligomer relative to the elastomeric and tack components. By one approach, the Adhesive Component Ratio or ACR for the adhesive is:

$$\frac{(\text{wt \% of acrylate oligomer})}{(\text{wt \% of elastomeric material} + \text{wt \% of tack control agent})} = 0.5 \text{ to } 1.5.$$

The ACR describes a weight percent of the energy-curable acrylic oligomer relative to a sum of the weight percents of the tack control component and the elastomeric material. The ACR is effective to provide an energy-cured adhesive with an adhesive mating force exhibiting a first peel adhesion between the contacting portions of the cooperating coupling parts of about 80 to about 900 grams per linear inch (gpli). In another approach, the ACR can be in the range of about 0.8 to about 1.5.

The range for the ACR of the three components in the formulation has been found to provide a unique adhesive with a low tack property to non-like substances (i.e., machine components, crumbs, food pieces, and the like), yet can seal to itself with sufficient bond or peel strength (i.e., a good cohesive) to maintain a seal therebetween as well as resist contamination. The adhesive in this specific ACR also provides for a resealable function that does not significantly reduce or lose its seal-peel-reseal qualities upon being subjected to repeated open and close operations. An ACR value below about 0.5 is generally undesired because the adhesive would require significantly large amounts of UV energy or electron beam energy to cure. If the ACR is above about 1.5, the adhesive would cure quickly, but it would also have low (or no) peel strength, unacceptable for the adhesive closure herein. In addition to the desired range of the ACR, a satisfactory adhesive formulation in some cases may also have certain other parameters such as mixture-stability of the components, a certain viscosity of the formulation, a certain cure rate, and/or a certain peel strength.

Not only is the ACR of the adhesive components desired, but the adhesive components must also be compatible with each other such that they form a stable flowable liquid mixture. As used herein, the adhesive is considered stable when it (at a minimum the two or three main components) remains a homogeneous liquid, i.e., there is no visible phase separation of the components and no gel formation, while being held at room temperature (about 70° F. to about 75° F.) for at least three days. In addition, the adhesive formulation can have a viscosity of about 10,000 cPs to about 50,000 cPs at room temperature (about 20 to about 25° C.) and less than about 2,000 cPs at about 70 to about 75° C. When applying the liquid PSA to the substrate during manufacturing, it may be applied at a temperature of about 86° F. (30° C.) to about 190° F. (88° C.) and, in some cases, at about 160° F. (71° C.). These viscosity ranges provide for applying the adhesive to a substrate using conventional printing, roll coating, slot die, or embossing application techniques.

The average initial peel strength of the mating portions constructed from a properly cured adhesive can be in the range of about 80 gpli to about 900 gpli and, in some cases, about 280 gpli to about 800 gpli, and in other cases, about 280 gpli to about 650 gpli, as measured by a test method as set forth in the Examples. The adhesive is also designed to retain its average peel strength after repeated open and close operations (i.e., adhesion retention). In one approach, the mating portions constructed from properly cured adhesive can retain its average initial peel adhesion between about 280 gpli and about 800 gpli up to at least five repeated peel-reseal cycles. This is called the adhesive retention value. Preferably, the adhesion retention value upon peeling-resealing-peeling can be between about 30% to about 200% retention of the initial value. In addition, the fasteners herein also provide a unique ability to resist contamination. Upon the fasteners experiencing contamination, the adhesion retention value may be between about 25% to about 150% of the initial value even when contacted with fine particulate, moisture, fats, and lipids.

In combination, the mechanical mating elements and the adhesive mating elements of the fastener combine to provide a total initial peel force between the opposing substrate portions of about 80 gpli to about 900 gpli and up to five subsequent peels between the opposing substrate portions of about 60 gpli and about 900 gpli.

In addition to the ACR, the adhesive formulation may also include other optional features or optional compositional components that may be helpful when forming the rather complex profiles and geometries of the mating portions and the cooperating coupling parts described above. For example, each of the opposing mating portions of the closure can have the same or different adhesive compositions. In one instance, the first mating portion 14*a* can comprise the acrylic adhesive disclosed above, while the second mating portion 14*b* can comprise a different adhesive formulation of a modified adhesive material so that it exhibits different properties of tack, rigidity, strength, elongation, and the like. Likewise, similar adhesive formulations can be used on the two opposing mating portions 14*a* and 14*b*, but each portion may be tailored to have different adhesive properties as needed for its particular application, such as different ACR ratios, different adhesive bonding properties, different peel force values, different elongation, different tack levels, and the like. If needed for a particular application, the two parts of the substrate closure, i.e., the two opposing mating portions 14*a* and 14*b*, can have the same or different surface tensions, the same or different elastomeric and mechanical strength properties, such as specific percent elongation, critical surface tension and tensile strengths, among others.

In addition, the acrylic adhesive may have a composition that exhibits either a pseudo plastic, such as shear thinning, behavior or a dilatant (shear thickening) behavior upon application of shear strain. Where the adhesive is pseudo plastic, i.e., shear thinning, the adhesive thins out when it undergoes shear strain, such as may occur when the liquid adhesive is forced to flow into a mold cavity. This will be discussed in more detail below, and more effectively fills all the void spaces in the mold, then stiffens up once the adhesive is in the mold to hold its shape.

In one embodiment, the cooperating coupling part of one mating portion may be more rigid than the cooperating coupling parts of the opposing mating portion and, as a result, one side of the fastener may be stronger and more rigid than the other. In another embodiment, one of the cooperating coupling parts may be more pliable and more flexible than the other, or any other combinations are possible. For example, it may be desired to have the male-type cooperating coupling part to be more rigid and the female-type cooperating coupling part to be more pliable so that the female part tends to flex or bend to allow receipt of the more rigid part therein.

One of the advantages of the fasteners herein is that the hybrid reclosable fasteners provides for both mechanical mating as well as a cohesive bond between opposing sides of the reclosable fastener at the same time to form, in some instances, an enhanced closure that is generally greater than the closure of either of these fasteners independently. To this end, the cooperating coupling parts can couple or mate with adjacent cooperating coupling parts when brought together (i.e., arrows X in FIGS. 1 and 2) to close the opposing substrate portions and form a mechanical coupling and cohesive bond due to the adhesive contacting portions.

In one approach, the selected pressure sensitive adhesive (PSA) forming the cooperating coupling parts 16 and 18 may exhibit an initial bonding strength or initial peel strength between the coupled portions 14*a* and 14*b* of about 80 g/inch to about 900 g/inch (i.e., or grams per lineal inch, gpli), and in some cases, between about 200 g/inch to about 400 g/inch as measured by the ASTM peel test. Such initial bonding strengths may be a combined bond of both the mechanical and adhesive mating components in the hybrid fastener. In another approach, the initial bond or initial peel strength may range from about 280 gpli to about 800 gpli. Initial bonds and peel strengths greater than this level (i.e., greater than about 900 gpli) are generally too high when used with certain substrates to be useful for a peelable and resealable fastener since the substrate may be damaged when the cohesive bonds are broken at these high strengths.

The mating portions 14*a* and 14*b* using the above described PSA may further have a secondary or subsequent peel or bond strength (i.e., an adhesive retention) between the mating portions 14*a* and 14*b* after at least five open/close operations of at least about 60 gpli, or in other cases at least about 30% to about 200% of the initial peel, and, at a minimum, about 50 g/inch to about 200 g/inch, where the subsequent peels include the seal-reseal action (opening and closing) that occurs after the initial opening and separation of the hybrid fastener. In general, these secondary or subsequent peel strengths may provide a greater level of bonding than if the fastener were constructed of a non-adhesive material or a fastener constructed of the adhesive alone.

The mating portions 14*a* and 14*b* may also maintain a bonding strength or peel strength therebetween when contaminated with food crumbs, oils, liquids, and the like between about 50 g/inch to about 900 g/inch, and exhibit a residual adhesion or residual cohesion after fouling or contamination of at least about 20%, and in some cases about 30% to about 150% of the bonding or peel strengths prior to contamination. Such bond strengths are maintained even when contaminated with fine particulate having an average particle size of about 150 microns or less, moisture, fats, and lipids. As used herein, adhesion remaining or residual cohesion after contamination is a measurement of the peel strength after direct contact of the mating portions to food particles, fats, lipids, and other contaminants relative to the peel strength of a clean or uncontaminated fastener, exhibited as a percentage.

By another approach, the cohesive bond and mechanical mating between the cooperating coupling parts 16 and 18 is generally sufficient to seal the coupling parts 16 and 18 together and, in some cases, also form a hermetic seal or a generally air tight seal.

The adhesive used for mating portions 14*a* and 14*b* also preferably has a relatively low tack level or stickiness that enables the fastener to minimize and, in some cases, limit the adhesion of the fastener 10 to unwanted materials (i.e., contamination) and surfaces, such as food particles, forming equipment surfaces, rollers, and the like. By one approach, the adhesive, when cured as a flat-level coating, may have a tack level to undesired surfaces not exceeding about 5 psi when preloaded with about 4.5 pounds using the ASTM probe tack test D2979. By another approach, the PSA coating may have a tack level not exceeding about 15 psi when preloaded with about 10 pounds. However, the tack level may also vary depending on the particular PSA and application thereof and measurement test used. Using another metric, the adhesive material used to make fastener 10 exhibits a tack when cured as a flat level-coating as measured by a modified version of a rolling ball test in ASTM D3121 where the adhesive tack permits about 1 inch to about 8 inches of ball travel. In some cases, up to about 14 inches of ball travel. The modified rolling ball tack test is explained in U.S. application Ser. No. 13/035,399, which is incorporated herein in its entirety.

Even with such relatively low tack levels to undesired surfaces, the mating portions 14*a* and 14*b* still form a sufficiently strong primary bond with the substrate 12 forming opposing substrate panels 12*a* and 12*b* so that the mating portions 14*a* and 14*b* are not substantially delaminated therefrom when the opposing portions 12*a* and 12*b* are separated. By one approach, the primary bond strength of the adhesive-based mating portions 14*a* and 14*b* to the substrate 12 at an interface 22 thereof (FIGS. 1 and 2) is generally greater than the peel strength or bond strength between the mating portions. For example, the primary bond strength of the mating portions 14*a* and 14*b* to the substrate forming the opposing substrate panels 12*a* and 12*b* is generally greater than about 600 g/inch, in other cases greater than about 900 g/inch. In other cases, greater than about 1000 g/inch and, in yet other cases, greater than about 1200 g/inch. In other instances, the primary bond strength of the mating portions to the substrate may range from about 600 to about 1200 g/inch. However, the primary bond strength may also vary depending on the substrate, the PSA, and other factors.

In addition, it is further anticipated that interfacial, mechanical, or chemical bonding of the mating portions 14*a* and 14*b* to the substrate 12 may be enhanced through particular constructions of the substrate materials 12. By one approach, the substrate 12 may be a single layer or a multi-layer film, and, in such a case, at least an innermost layer of the substrate film 12 forming the opposing substrate panels 12*a* and 12*b* may be composed of a polymer blend containing ethylene vinyl acetate (EVA), linear low density polyethylene (LLDPE), and adhesion promoting filler particles. Where the adhesion promoting filler particles are present in the substrate 12 (to be discussed further below), it may be present in and dispersed throughout and, at a minimum, throughout at least this innermost layer (i.e., EVA/LLDPE blend). By one approach, the EVA is the predominant component of the blend, at about 65% to about 90%, and the LLDPE is a minor component of the blend, at about 5% to about 25%.

In other approaches, the substrate, innermost layer, and/or the blended EVA/LLDPE layer may have low concentrations of migratory slip additives (commonly added to some packaging substrates in order to obtain a coefficient of friction suitable to process the substrate on form, fill, and seal machines). It is appreciated that such additives may include amounts of fatty acid amides, and it has been discovered that such compounds can affect the bond strength of cohesive materials to the substrate because the slip additive may block surface sites where adhesion can take place. By one approach, therefore, the substrate 12 may have less than about 1000 ppm of fatty acid amides (i.e., migratory slip additives) throughout the innermost layer or, in some cases, throughout the entire substrate 12.

While not wishing to be limited by theory, it is believed that fatty acid amides, which are low molecular weight components, can migrate or bloom to the surface of the substrate affecting the strength of the bond between the substrate's surface and the mating portions 14*a* and 14*b*. While corona treating or flame treating may initially burn off any fatty acid amides on the surface of the substrate 12 resulting in an initial good bond strength to the mating portions, over time additional fatty acid amides can migrate or bloom to the substrate surface, which results in a reduced bond strength over an extended shelf life. As a result, in some cases it may be desired to reduce the fatty acid amide content in the substrate (either the inner most layers or the entire substrate) to levels below about 1000 ppm, in some cases, to about 700 ppm or below and, in other cases, no slip additives. In some approaches, such levels provide for both good initial bond strength and good long term bond strength, in combination with other factors, because there are such small amounts of these impurities to bloom to the substrate surface over time. Alternatively, such substrate formulation variations may also be combined with use of other surface treatments (corona treating, plasma treating, flame treating, and the like) or other coatings as needed for a particular application.

Additionally, prior to applying the adhesive to the substrate, the substrate can undergo a surface pretreatment to increase the surface energy, and/or application of a primer coat. For example, surface treatments may include corona treating, plasma treating, flame treating, and the like or chemical coatings, such as primers or adhesion promoters may also be used. A corona treatment can increase the surface energy of the substrate which improves the coating's ability to bond and remain bonded to the substrate. A corona pretreatment can include a cloud of ions that oxidize the surface and make the surface receptive to the coating. The corona pretreatment basically oxidizes reactive sites on the polymer substrates. If corona treating, ideally the surface energy after treatment should be about 36-40 dynes/cm or greater at the time of coating application. Without wishing to be bound by theory, it is also believed that the corona treatment of the substrate surface helps to provide for a strong bond between the coating layer and the substrate surface due to the increased surface energy of the substrate. In addition to the corona treatment, the combination of the corona treatment with a low concentration of a slip additive and the incorporation of a filler composition within the substrate film 12 together result in a strong bond between the patterned reclosable fastener and the substrate. While corona treating or flame treating may initially burn off any fatty acid amides on the surface of the film resulting in an initial good bond strength of the adhesive. Over time additional fatty acid amides can migrate or bloom to the film surface, which results in a reduced bond strength over an extended shelf life. Thus, approaches of the fasteners herein may use the reduced levels of fatty acid amides to minimize and reduce the latent blooming of these components.

In one form, the substrate 12 can be flexible sheet material or film, which may be formed of various plastic polymers, co-polymers, papers, foils or combinations thereof. The film substrate may be a multi-layer coextrusion and/or a laminate with constructions to enhance interfacial bonding with the energy-cured patterned adhesive fastener 10. In general, the polymeric layers may include polyolefins such as polyethylene (high, medium, low, linear low, and/or ultra low density polymers including metallocene or polypropylene (oriented and/or biaxially oriented)); polybutylene; ethylene vinyl acetate (EVA); polyamides such as nylon; polyethylene terephthalate; polyvinyl chloride; ethylene vinyl alcohol (EVOH); polyvinylidene chloride (PVDC); polyvinyl alcohol (PVOH); polystyrene; or combinations thereof, in monolayer or multi-layer combinations. In one aspect, the film substrate includes EVA. By one approach, the film substrate can have a film thickness between about 0.5 mils to about 5 mils thick. Examples of suitable film substrate may be found in United States Publication Numbers 2008/0131636 and 2008/0118688, which are both incorporated herein in their entirety.

By one approach, the substrate 12 may be a single layer or a multi-layer film. An exemplary multi-layer film may include an inner heat sealable (sealant) layer to which the mating portions 14*a* and 14*b* are bonded and one or more structural and/or functional layers. In one particular example, the substrate 12 may include the inner sealant layer and an outer structural layer including one or more layers of high density polyethylene and/or one or more layers of nylon. The inner sealant layer may include various polymers and/or blends of polymers. By one approach, the inner sealant layer may include blends of ethylene vinyl acetate (EVA), polyethylene (such as linear low density polyethylene-LLDPE), and the optional adhesion promoting filler particles dispersed throughout to be described below. For example, the inner sealant layer may include about 60% to about 80% EVA, about 5% to about 20% polyethylene, and about 0.5% to about 20% of the adhesion promoting filler particles or a filler composition including such particles. Such construction may form a polymeric dispersion in which the EVA may be a primary or continuous phase in which the polyethylene and filler particles/filler composition is a dispersed phase therein. With this approach, the adhesive forming the mating portions 14*a* and 14*b* is applied to the inner sealant layer, which forms the inner surface of the substrate. By another approach, the multi-layered film may include multiple layers such that about 85% of the total film thickness is high density polyethylene and about 15% of the film thickness is the sealant layer.

By another approach, the substrate may be a paperboard or the like material having a coating or polymer layer applied thereon. The coating or polymer layer may include an ethylene vinyl acetate (EVA), polyethylene, and blends thereof. This coating may include the fillers described above and may also include the fillers supplied in the maleic anhydride grafted linear low density polyethylene carrier (MA-LLDPE) as described below. In yet other instances, the substrate may also be a fabric, foam, or other porous materials.

Figure 17:
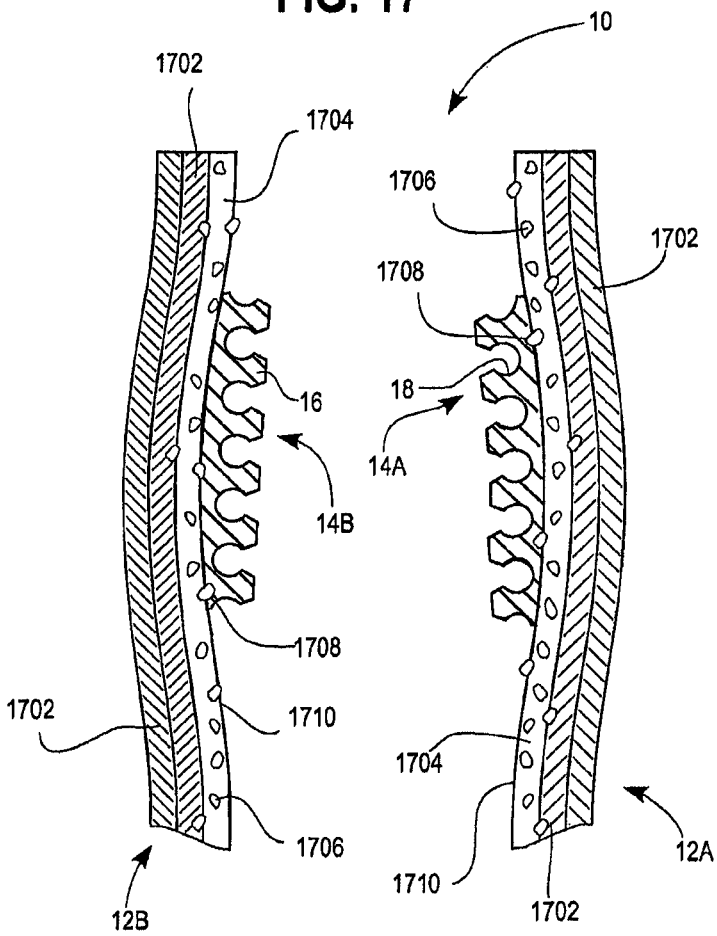
FIG. 17 is a cross-sectional view of another exemplary adhesive-based reclosable fastener.

In one form, at least one portion of the construction of the substrate 12 to enhance interfacial bonding or the primary bond between the mating portions and the substrate may include the adhesion promoting filler particles mentioned above. These particles may be blended with at least a portion of the substrate, such as, the adhesion promoting filler particles blended into the inner sealant layer of a film as generally shown in FIG. 17. By one approach, the adhesion promoting filler particles may be micro- or nano-sized particles of clay, calcium carbonate, montmorillonite, microcrystalline silica, dolomite, talc, mica, oxides, (silicon oxides, aluminum oxides, titanium oxides, and the like) and other additives and/or combinations thereof, into at least the inner, sealant, or surface layer(s) of the substrate to enhance the bonding of the mating portions 14*a* and 14*b* to the substrate 12*a* and 12*b*. By one approach, the adhesion promoting filler particles are an organoclay, and in one aspect the organoclay may be organically modified montmorillonite or an exfoliated organoclay. Organoclay is an organically modified natural clay such as a montmorillonite clay that is processed or treated with surfactants such as quaternary ammonium salts. Montmorillonite is a phyllosilicate group of minerals that typically comprises a hydrated sodium calcium aluminum magnesium silicate hydroxide. While not wishing to be limited by theory, the organoclay-filled substrate and, in particular, the organically modified fillers used for the adhesion promoting filler particles can have the ability to aid in producing operable and reclosable adhesive-based closures that do not delaminate from the substrate upon being peeled open.

In some approaches, useful adhesion promoting filler particles have a surface area greater than about 100 $m^2$/gram and an aspect ratio greater than about 10. In other approaches, the organoclay used in the peelable sealing layer typically comprises a plurality of particles. In one variation, the organoclay comprises a plurality of particles having at least one spatial dimension less than about 200 nm. In another variation, the organoclay comprises a plurality of particles having at least one spatial dimension less than about 100 nm. In another variation, the organoclay comprises a plurality of particles having at least one spatial dimension less than about 50 nm. In still another variation, the organoclay comprises a plurality of particles having spatial dimensions greater than or equal to about 1 nm. In still another variation, the organoclay comprises a plurality of particles having spatial dimensions greater than or equal to about 5 nm. In another variation, the organoclay comprises platelets having an average separation of at least about 20 angstroms. In yet another variation, the organoclay comprises platelets having an average separation of at least about 30 angstroms. In still another variation, the organoclay comprises platelets having an average separation of at least about 40 angstroms. Typically, before combining with the thermoplastic polymer, the organoclay comprises platelets having an average separation between from about 20 to about 45 angstroms. Advantageously, upon combining with the thermoplastic, the organoclay remains in this state such that the average separation is maintained or increased.

By one approach, suitable flexible films forming the opposing substrate panels 12*a* and 12*b* may be a polyethylene based film about 0.5 mils to about 5 mils thick and, in some cases, about 3 mils thick. Turning again to FIG. 17 for a moment, one approach of a flexible film forming the opposing substrate panels 12*a* and 12*b* is shown as a multi-layer, coextruded film including a structural base of one or more layers (two are shown) of a high density polyethylene 1702 (HDPE) and an inner or adhesive receiving layer (such as the above described sealant layer) of an EVA/LLDPE heat seal layer 1704 filled with adhesion promoting filler particles 1706. With this approach, the mating portions 14*a* and 14*b* formed of the adhesive is applied to the inner EVA/LLDPE heat seal layer 1704, which forms the inner surfaces of the fastener 10.

As shown in FIG. 17, the adhesion promoting filler particles 1706, which may be organoclay, are generally exaggerated in size for illustrative purposes, but are expected to be dispersed throughout the inner EVA/LLDPE or sealant layer 1704, and it is expected that at least some of the adhesion promoting filler particles (identified as filler 1708 in the drawing), for example, may have at least a portion thereof exposed or protruding slightly out of an outer surface 1710 of the EVA/LLDPE layer 1704, as generally provided in application Ser. No. 12/435,768, which is hereby incorporated herein by reference in its entirety. Alternatively, the adhesion promoting filler particles may not be exposed at the surface 1708, but they may create a rougher outer surface, which increases the surface area for bonding to the adhesive. While not wishing to be limited by theory, the adhesion promoting filler particles 1708 at the surface or exposed from the surface combined with corona treatment and/or the use of certain carriers for the filler may aid in the bonding of the mating portions to the substrate, which may provide an effective primary bond to the substrate that is greater than the mechanical and cohesive peel strength between the two mating portions 14*a* and 14*b*. In general, it is expected that when the bonding force is between about 600 g/inch to about 900 g/inch between the two mating portions 14*a* and 14*b*, no delamination occurs from the substrate 12 during repeated peel/reseal cycles between the mating portions and the substrate when the fillers and sealant constructions described herein are used. Thus, the primary bond of the mating portions 14*a* and 14*b* to the substrate with the adhesion promoting filler particles 1706 therein is greater than about 600 gpli and, in some cases, greater than about 900 gpli as discussed previously.

In other instances and while not wishing to be limited by theory, the enhanced primary bond between the mating portions 14 and substrate 12 may be due to a diffusion of the liquid or uncured adhesive used to form the mating portions 14 (prior to being cured into coupling parts) into gaps, voids, or other spacing of the adhesion promoting filler particles (such as the spacing between the organoclay platelets) and, in particular, into these gaps, void, or other spacing of the filler particles having at least a portion thereof exposed at the surface of the substrate. Upon subsequent polymerization and curing, the diffused liquid adhesive forms into a solid adhesive that may be interlocked, tied or otherwise bound to the adhesion promoting filler particles to increase the primary bond to the substrate. In yet other instances and again not wishing to be limited by theory, the enhanced primary bond may also be due to an affinity of the polar portions of the adhesive to the polar filler particles. In general, the filler particles are more polar than the substrate and, thus, provide a greater bond thereto.

Effectively dispersing the adhesion promoting filler particles in polyethylene and EVA used for the substrate and/or sealant layer can be a challenge due to incompatibility of particles and certain polymers. Thus, supplying the adhesion promoting filler particles using a filler composition including the adhesion promoting filler particles blended with a compatible carrier helps aid in the mixing and dispersing of the filler into the sealant layer of one form of the substrate 12. By one approach, the adhesion promoting filler particles and, in some cases, the organoclay can be supplied in a maleic anhydride grafted linear low density polyethylene carrier (MA-LLDPE). By another approach, the carrier may be a blend of MA-LLDPE and unmodified polyethylene. While not wishing to be limited by theory, the maleic anhydride portion of the carrier has an affinity for the organoclay or other adhesion promoting filler particles, and the polyethylene portion of the carrier mixes well with other polymers of the sealant layer or substrate 12. Exemplary filler compositions may be obtained from PolyOne Corporation (Avon Lake, Ohio). Without wishing to be bound by theory, it is believed that the organically modified clay particles, which may be highly polar, and/or the maleic anhydride grafted linear low density polyethylene (MA-LLDPE) carrier resin present with the clay fillers serve to promote adhesion of the cured adhesive coating to the substrate surface by increasing the surface energy and polarity of the substrate layer.

Additionally, it is also believed that on a microscopic level the organoclay or other adhesive promoting filler particles may impart surface roughness to the substrate, positively affecting the coefficient of friction of the substrate and increasing the available contact area between the substrate and the mating portions, thereby providing more sites for chemical and/or mechanical bonding to occur. This will be discussed in more detail below. By one approach, approximately 0.5% to about 20% by weight of the filler composition in the sealant layer is expected to have a beneficial impact on primary bond strength of the mating portions 14*a* and 14*b* to the substrate material 12 so that the primary bond to the substrate is greater than the peel adhesion between the mating portions 14*a* and 14*b* such that the fastener 10 does not delaminate upon opening. Additionally, the adhesion promoting filler particles may roughen the surface of the substrate layer enabling it to slide freely over metal or plastic surfaces of packaging equipment without binding, thus enabling the reduction or elimination of a migratory slip additive in the film. In some approaches, the inner sealing layer having the adhesion promoting filler particles has a higher degree of surface roughness, such as an average roughness of about 100 to about 30,000 angstroms, and in some cases, about 1500 angstroms to about 5000 angstroms. The sealing layer may also have a higher tensile modulus than layers without the filler. In some approaches, the inner sealant layer has a tensile modulus of about 500 to about 2000 mPa.

Figure 18:
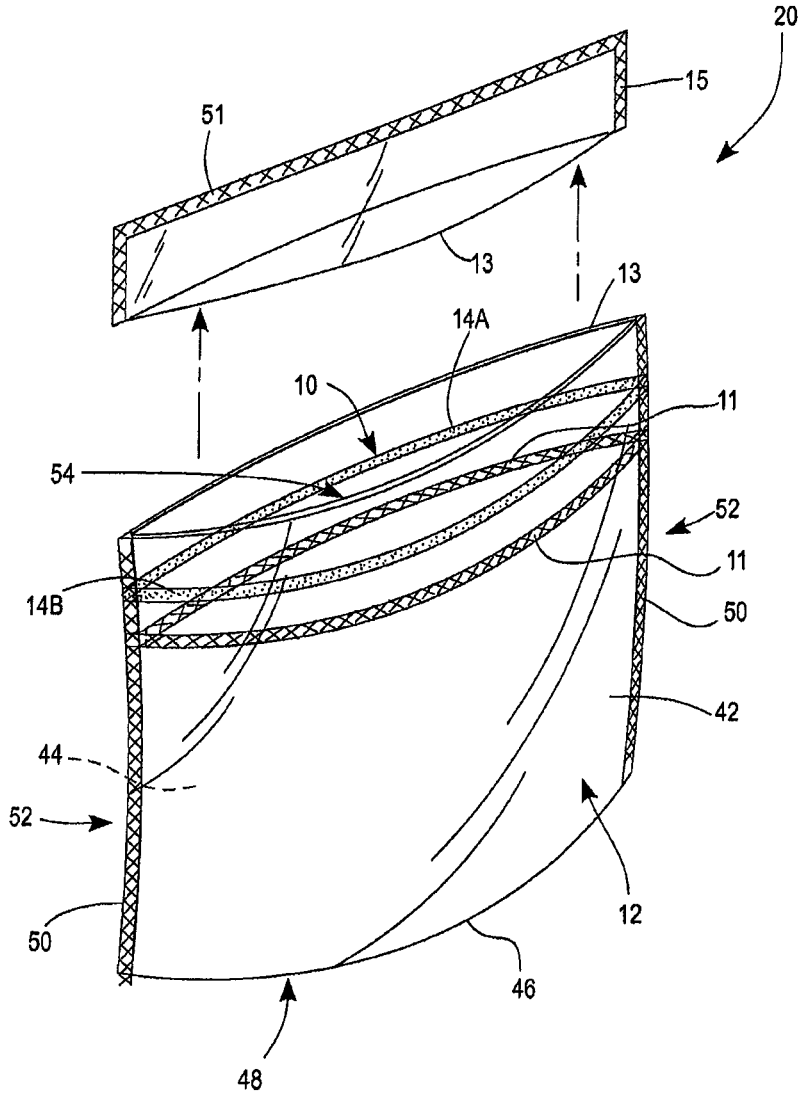
FIG. 18 is a perspective view of an exemplary flexible package having an adhesive-based reclosable fastener thereon illustrated in an open condition.
Figure 19:
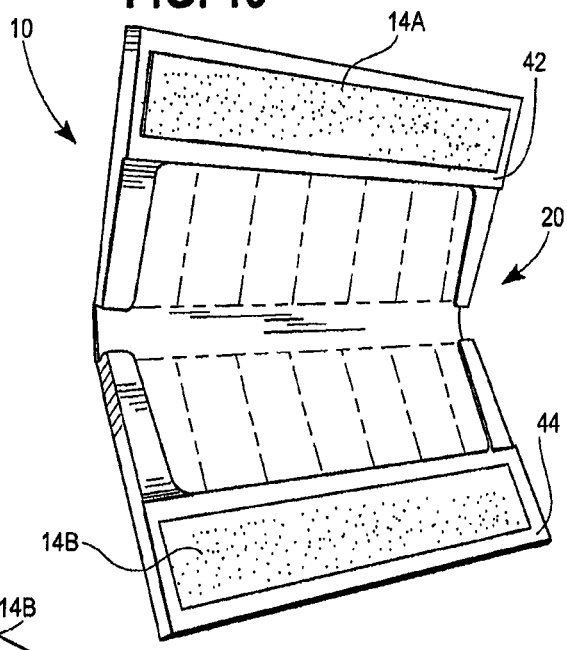
FIG. 19 is a perspective view of an exemplary rigid package having an adhesive-based reclosable fastener thereon.
Figure 20:
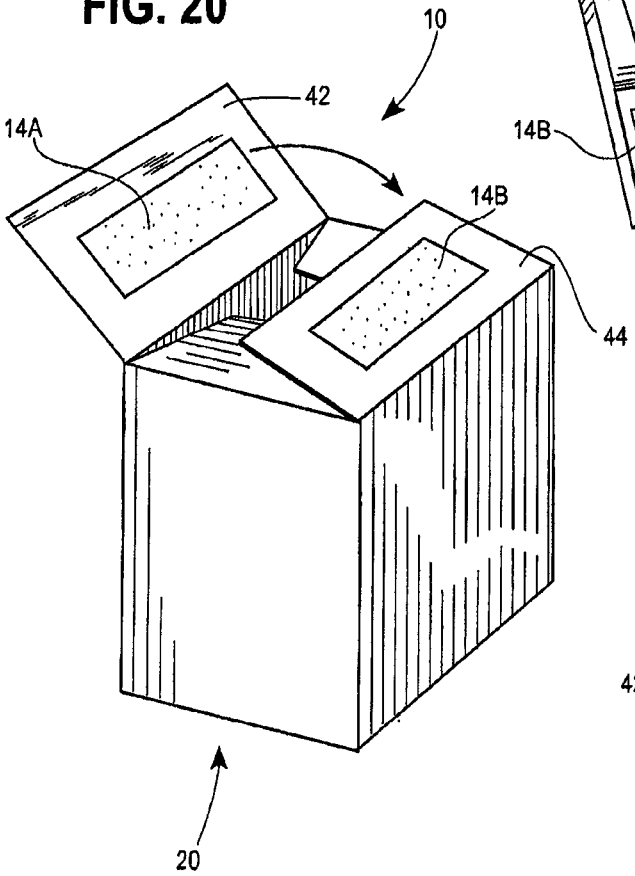
FIG. 20 is a perspective view of a second embodiment of an exemplary package with a pivotable cover, the package having an adhesive-based reclosable fastener thereon.
Figure 21:
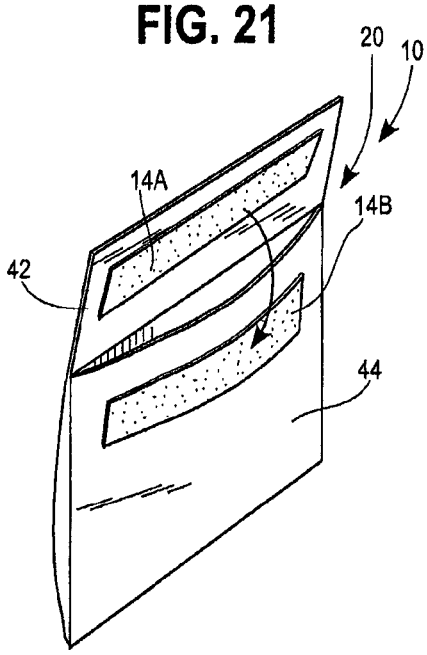
FIG. 21 is a perspective view of a third embodiment of an exemplary rigid package having an adhesive-based reclosable fastener thereon.

Turning now to FIGS. 18-21, exemplary applications of the hybrid reclosable fastener 10 on packages, containers, and boxes are illustrated to suggest but a few applications. For example, the fastener 10 may be used on flexible-type packages (such as a pouches, bags, sachets, and the like) as generally shown by the example in FIG. 18 as well as more rigid packages, such as boxes, cartons, envelopes and the like as generally shown by the examples of FIGS. 19-21. Of course, other applications are also possible.

In general, if used on flexible packaging, the flexible package may include a plurality of walls or panels that form a cavity therein configured to receive one or more products. By some approaches, the package further includes opposing panels of packaging substrate configured to join together to restrict or block access, to contain items, and/or to preserve freshness. The reclosable fastener, including both mechanical mating as well as adhesive mating elements or characteristics, can be disposed on the opposing panels to provide a reclosable package. So configured, a user can separate the opposing panels and the opposing mechanically coupled and adhesive portions disposed thereon to access the one or more products in the cavity. Then, the user can join the opposing panels together, such as by shifting the panels toward each other or pivoting one or both of the panels with respect to the other, and applying slight pressure to couple the cooperating coupling parts together as well as to adhere the opposing adhesive portions thereon, which recloses the package. These open and reclose operations can be repeated several times with minimal to no loss of bond strength of the reclosable fastener.

FIG. 18 generally illustrates an exemplary flexible package utilizing the hybrid mechanical and adhesive-based reclosable fastener 10. FIG. 19 generally illustrates a package 20 in the form of a more rigid hinged-type box suitable for containing one or more items, such as gum pieces. FIG. 20 is a box or carton 20 having the hybrid mechanical and adhesive-based reclosable fastener 10, and FIG. 21 shows an envelope or paper-based pouch 20 utilizing the hybrid mechanical and adhesive-based reclosable fastener 10. It will be appreciated that FIGS. 18-21 simply show examples of packages and other types, sizes, and configurations of the package, containers, objects and the like may also be used as needed for a particular situation.

In the exemplary form of FIG. 18, the package 20 may also include a dead fold 46 along a bottom edge 48 thereof and transverse or side seals 50 along side edges 52 thereof so that the package 20 forms a cavity 54 between the front panel 42 and the back panel 44 for containing an item, such as a food item, comestible, or other material. The package 20 may further include a top seal 51 above the hybrid mechanical and adhesive-based reclosable fastener 10, when the package 20 is oriented in an upright position. It will be appreciated that the form of package 20 is only an example of but one type of a package suitable for use with the hybrid mechanical and adhesive-based reclosable fastener 10. As set forth above, other shapes, configurations, materials, and container/package types may also be combined with the hybrid mechanical and adhesive-based reclosable fastener 10. The package 20 may further include other folds, seals, gussets, and/or flaps as generally needed for a particular application. The package 20 may also include a bottom seal at the bottom edge 48 instead of a fold 46. Optionally, the package 20 may also include non-reclosable peel seals 11 either above or below the reclosable fastener 10 as generally provided in U.S. application Ser. No. 11/267,174, which is hereby incorporated herein by reference in its entirety. Additionally, the package 20 may also optionally include a rupturable line of weakness 13 between the reclosable fastener 10 and an upper end of the package 20, which, upon complete rupturing, is adapted to remove a portion of the upper end of the package 20 by providing a removable shroud 15 above the reclosable fastener 10 to provide a package opening.

In general, the packages 20 of FIGS. 19-21 are formed from one or more portions, panels, or pieces of material or substrate 12 formed into opposed front and back panels, walls, and the like (shown as panels 42 and 44 in the Figures). The opposing walls also have opposing portions or mating portions 14*a* and 14*b* disposed thereon. As discussed above, however, the package can take a variety of forms having a variety of configurations or openings therein suitable for closure by the reclosable fastener 10, and specifically the opposing portions or mating portions 14*a* and 14*b*.

Turning back to FIGS. 1, 2, 5, and 6 for a moment, to close the opposing substrate portions 12*a* and 12*b*, a user (or a machine closing operation during forming operations) squeezes or presses the opposing panels 12*a* and 12*b* together in the direction of arrows X, as shown in FIGS. 1 and 2, to engage the opposing mating portions 14*a* and 14*b* to couple or mate the coupling parts as shown in FIG. 5 and to form the mechanical mating as well as a cohesive bond between the adhesive contacting portions 20 and 22. By one approach, the mating layers 14*a* and 14*b* are configured to be closed and re-opened multiple times and, in some cases, the layers 14*a* and 14*b* preferably have sufficient structural and bond integrity to be closed and opened about 5 to about 10 times or more with no substantial permanent deformation, delamination, or diminishing of the bonding strength between the mating portions. However, particular layers and packages can be configured to be opened and closed any number of times depending on the particular configuration, coating weight, and other parameters of the cohesive layers and package substrate.

By some approaches, the fastener 10 may be used on packages to store a wide variety of food as well as non-food items. Food items that may be stored can include, but not limited to, snacks, trail mix, nuts, seeds, dried fruits, cereals, cookies, crackers, snack chips, chocolate, confections, and the like. Packages using the fasteners herein can also be used to store beverages, cheese, meat, cereal, ground coffee beans, desserts, pet food, liquids, other fine powders, and the like. In particular, foods or materials that have a fine particulate size, such as less than about 150 microns, a high moisture level, and/or a fatty content are particularly suited for use with this fastener because it will not substantially diminish in bonding strength if exposed to contamination from these types of products. Other possible applications of the packages using the fasteners herein can include packaging for various items that will benefit from resealability and permit multiple openings. This can include non-food items, such as potting soil, household storage bags, first aid kits, nuts and bolts, office supplies, cleaning supplies, laundry supplies, disposable eating utensils, CDs and/or DVDs, toys, modeling supplies, art and craft supplies, electrical supplies, and the like. Many other examples are, of course, possible.

The hybrid mechanical and adhesive fastener described herein can also be used for non-packaging applications, such as for consumer products that require a reusable fastener. For example, the fasteners could be used for disposable diapers, as fasteners on articles like athletic shoes, fasteners for jacket front openings, fasteners for pocket closures, or other types of clothing apparel, fasteners for office or school supplies such as folders and portfolios, closures on camping tents or back packs, as repositionable labels or markers for posters and maps for educational supplies/classroom instructional materials, fasteners for arts and crafts such as scrap-booking, repositionable fasteners for board game pieces, or repositionable strapping for bundling goods during shipping that are easy to apply and remove.

Now that the hybrid fastener and possible uses thereof has been described, exemplary methods of manufacture will be illustrated by reference to FIGS. 22 to 25. The formation of the hybrid fasteners is described together with a flexible film. It will be appreciated, however, that other manufacturing methods could be used to form and apply the hybrid fasteners herein to other types of substrates and objects.

Figure 22:
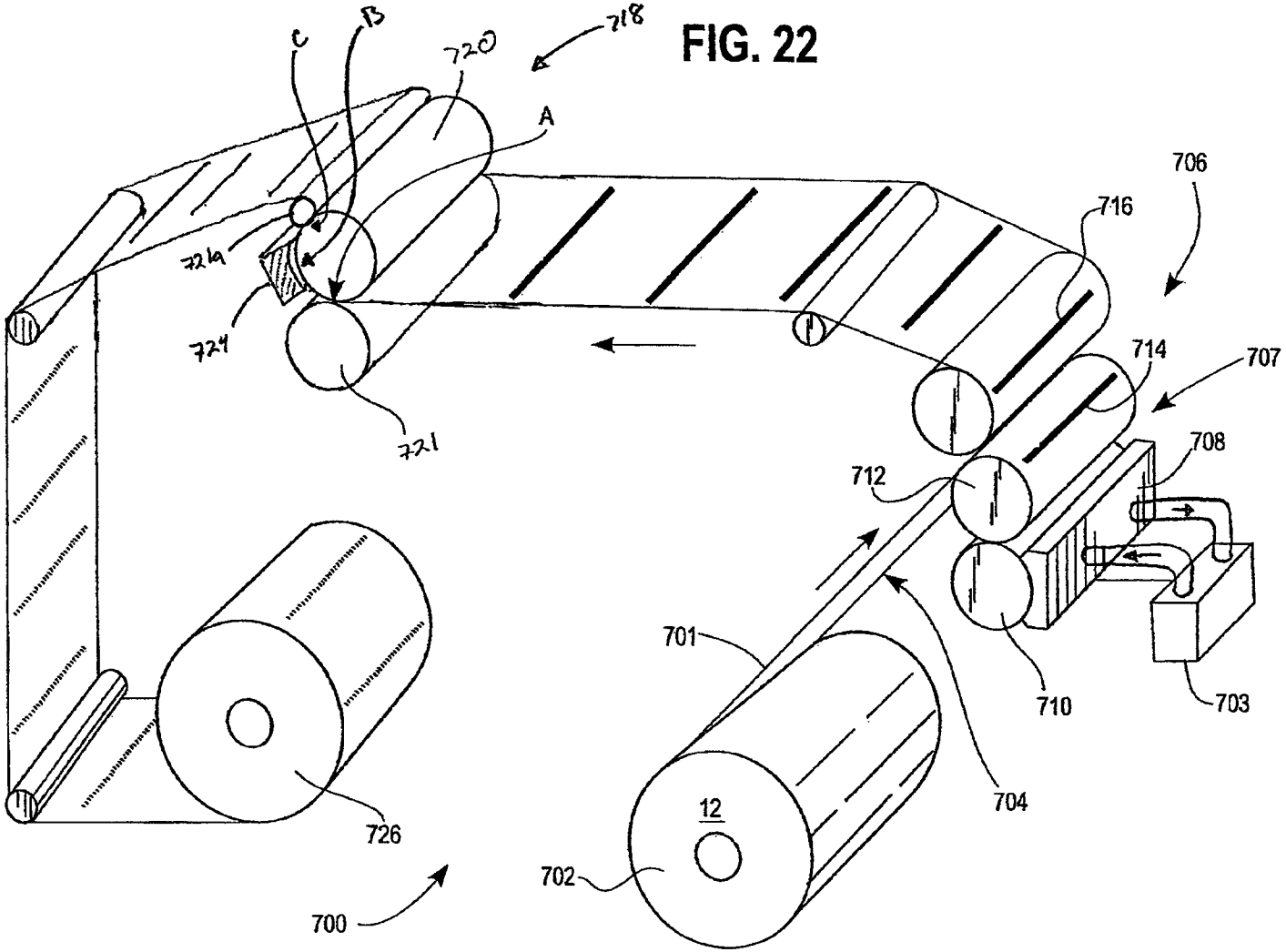
FIGS. 22 and 23C are exemplary processes to apply the adhesive-based reclosable fastener to a package substrate.

FIG. 22 shows an example of a suitable process 700 that may be used to apply, form, and cure the mating portions 14 on a substrate 12 thereby creating the shapes and profiles defining the cooperating coupling parts. It will be appreciated that other application processes or methods may also be used as needed for a particular application. In this exemplary approach, the substrate having the hybrid fastener thereon can be a film wound up into a roll that is later transferred to a form, fill, and seal machine to form the package.

In this exemplary process 700, the substrate 12 is a flexible film 701 provided in a large jumbo or roll 702, which may be the single layer or multi-layer film described above. The film 701 may have the EVA/LLDPE sealant layer as its inner layer 704 to which a liquid adhesive 703 is applied. The film 701 is unwound and directed to an adhesive application station 706 where an uncured liquid adhesive 703 is applied to the inner layer 704 of the substrate 701 via an applicator 707. By one approach, the liquid adhesive materials may be applied with a viscosity of about 2,000 cPs or less at about 70 to about 75° C. When applying the liquid adhesive, it may be applied at a temperature of about 160° F. (71° C.), but can be in the range of about 86° F. (30° C.) to about 190° F. (88° C.) as needed for particular circumstances. The adhesive may be applied to the film 701 as a transverse strip 716, as generally shown in FIG. 22, using any roll coating, die extrusion, printing, rotogravure, or flexographic printing process suitable to apply a strip of the adhesive to the film. As shown, the exemplary process uses an applicator 708, a ANILOX roll 710, and an imaged roll 712. In some approaches, the adhesive may be diluted in ethyl acetate solvent and applied at room temperature.

Figure 22A:
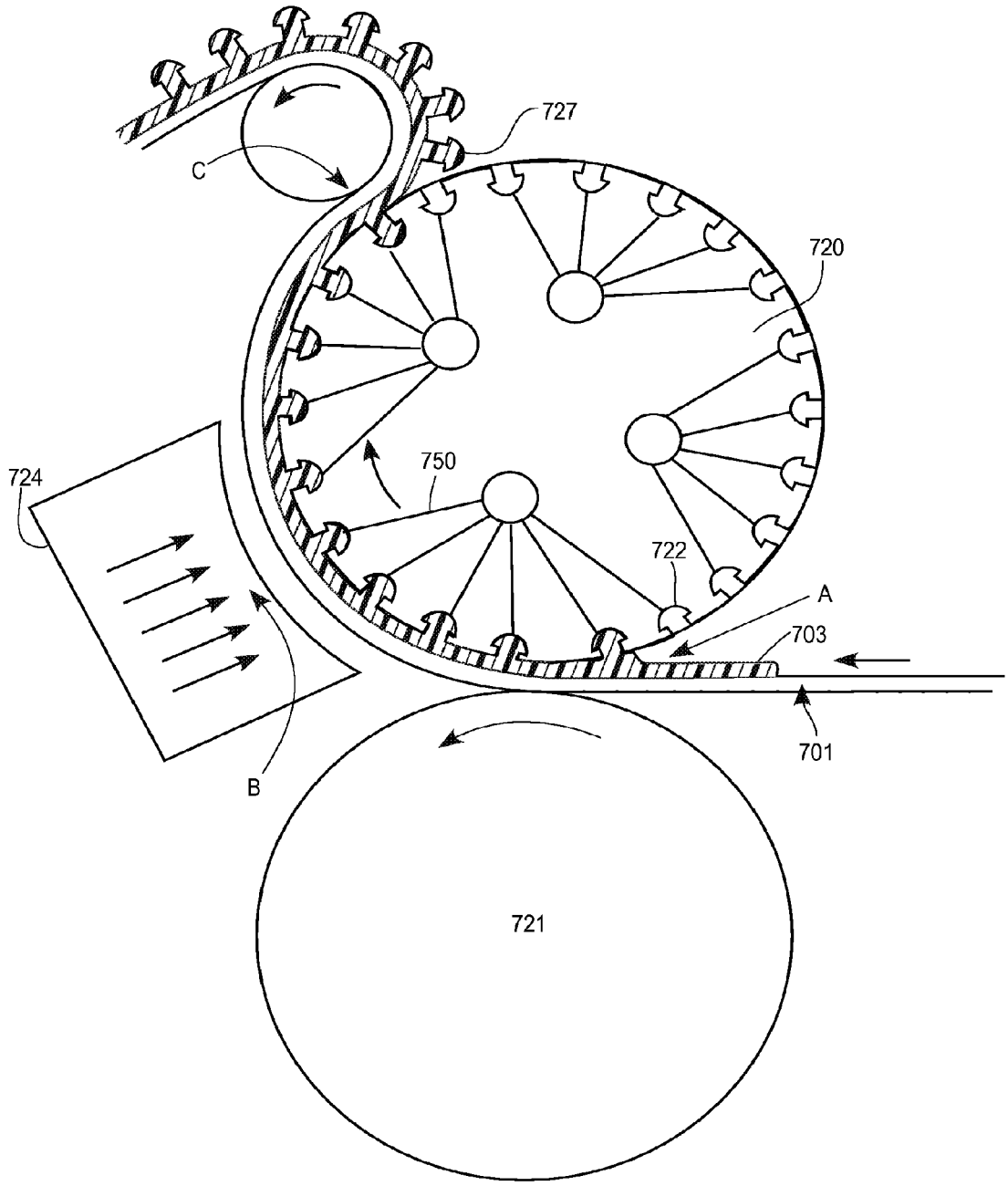
FIGS. 22A, 23, 23A, and 23B are cross-sectional views of exemplary molding and curing stations.
Figure 23:
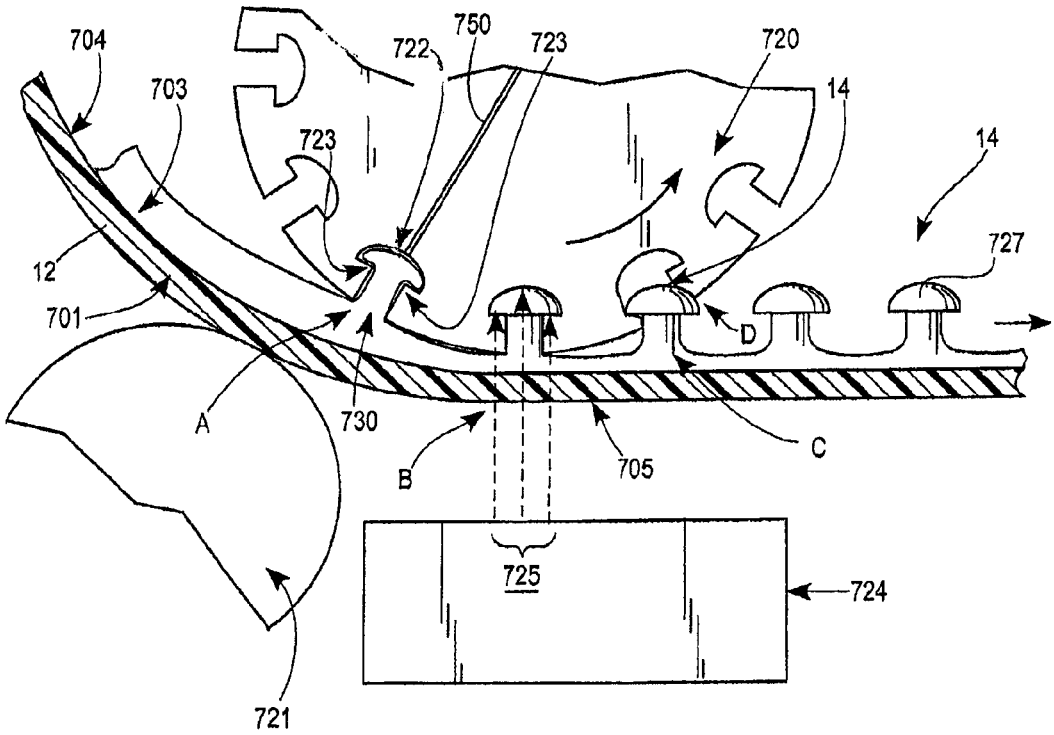
Figure 23A:
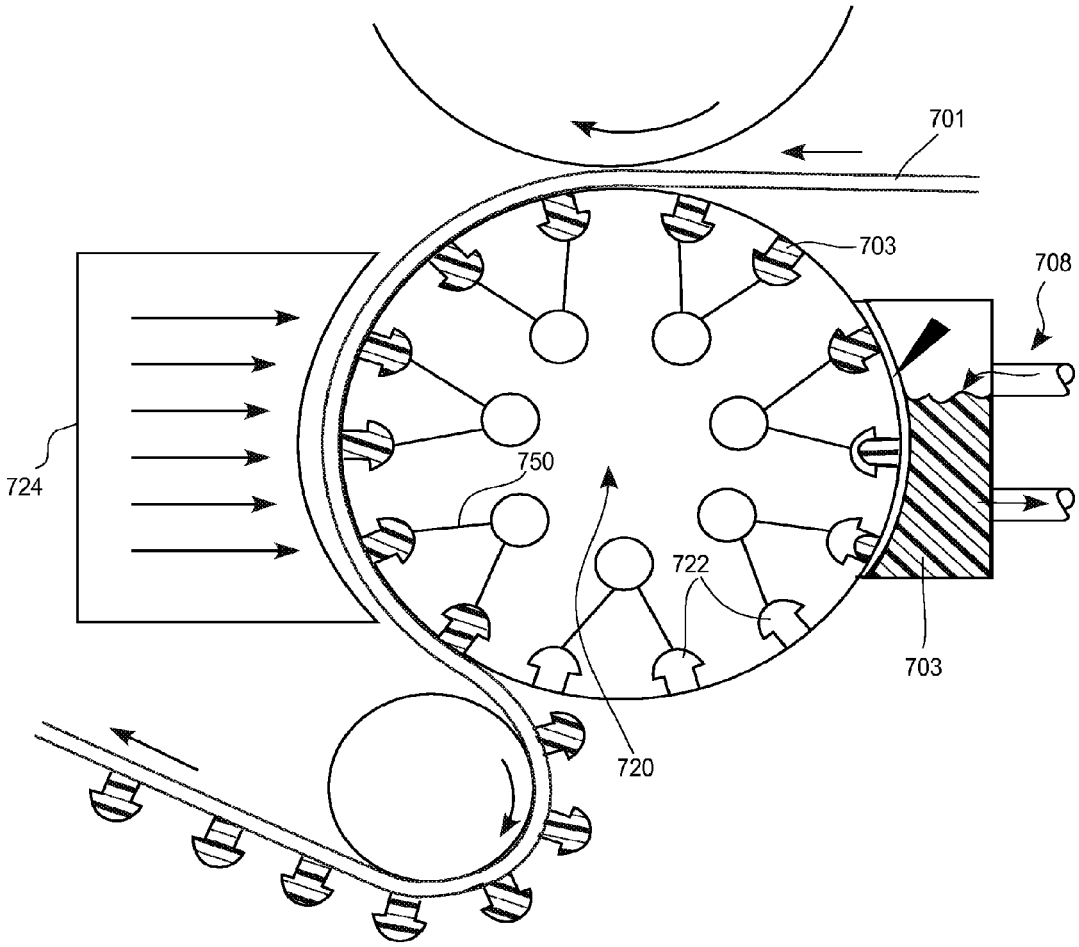

After application of the adhesive 703 to the film substrate 701, the coated substrate passes to a curing station 718 shown in FIGS. 22, 23, and 23A. At the curing station 718, a patterned roll-mold 720 is positioned adjacent a backing roll 721 between which the coated substrate passes. As the coated substrate passes between the two rollers, the adhesive is contacted with the mold 720 and pressed 730 into cavities 722 of the mold to fill up the cavities 722 with the liquid and uncured adhesive as generally shown in the exemplary approach of FIGS. 22, 22A, and 23 at position A. The roll-mold 720 is configured to form the liquid adhesive into the shapes of the various mating portions 14 discussed above. To this end, the roll-mold 720 defines cavities 722 that are shaped and sized as the desired mating portions 14 and coupling parts thereof. Because the desired shapes of the coupling parts of the mating portions can include, for example, bulb-like or mushroom-like shapes with the corresponding undercut portions, the mold cavities 722 can likewise contain undercut portions 723 that can form these shapes as generally shown in the exemplary mold of FIG. 23, which shows the mold cavities 722 having the profile suitable to form the shape of the mating portions depicted in FIGS. 12 and 13. As discussed further below, due to these undercut mold portions 723, the mold 720 may be formed from a resilient or flexible material so that the roll may flex or bend to permit the formed and cured adhesive and mating portion shapes to be easily released from the mold cavities 722. In addition, the adhesive may be energy cured, such as UV-cured and/or E-beam cured, so the flexible mold 720 may also be constructed of transparent materials having a transparency sufficient to allow the UV or E-beam to pass through to reach the undercut portions to ensure that all areas of the adhesive in the mold is adequately cured. Transparency of the mold and the film materials may be defined as the percentage of the incident radiation (either UV or electron beam) that is transmitted through a given thickness of the material (in this case an elastomeric mold material). For example and by some approaches, at least about 50% (and preferably about 80 to about 100%) of incident radiation is transmitted through a thickness of the mold which is equal to the height of a mating feature or the depth of a mold cavity. In one case, such levels of incident radiation transmission can be through about 0.001 up to about 0.030 inches of mold material.

As the coated substrate continues to advance along the roll-mold 720 and while still in contact with the roll-mold 720, it advances along to a curing source 724, as indicated by position B in FIGS. 22, 22A, and 23. By one approach, the curing source 724 may be either an ultraviolet lamp or an electron beam energy source. The adhesive within the roll-mold 720 is exposed to the energy source 724 for a time and amount effective to sufficiently cure the adhesive while it is still contained within the cavities 722 of the mold 720. In one instance, where a UV energy source is used, the UV light source is capable of delivering energy in the range of about 100 mJ/cm$^2$ to about 800 mJ/cm$^2$. In another approach, UV radiation has about 10 nm to about 400 nm wavelength supplied at an energy level between about 100 mJ/cm$^2$ to about 800 mJ/cm$^2$, and in other cases about 400 mJ/cm$^2$ to about 730 mJ/cm$^2$. In another instance, where an electron beam energy source is provided, it is supplied at an energy level of about 50 to about 200 kV and a total dose of about 1 to about 10 mRad. Such levels of curing are adequate to form the mating portions 14 as well as to ensure the adhesive has sufficiently cured as determined by an MEK rub resistance test value (ASTM D5402-06) of about 100 double rubs or more (to be discussed in further detail herein).

As shown in FIG. 22A or 23, the curing source 724 may be provided on the back side 705 of the film 701. Thus, in order to fully cure the adhesive, the UV or electron beam energy 725 needs to pass through the film substrate 701, as well as the portions of the mold forming the undercut areas 723. To this end, the film 701, as well as the mold itself 720, 723, may be sufficiently transparent to the energy source to permit the UV and/or e-beam energy from passing therethrough in order to adequately cure all areas of the liquid adhesive in the mold as generally shown by the directed energy 725 in FIG. 23. If the mold was not sufficiently transparent to the curing energy, the undercut areas 723 of the mold 720 would form shadows or other areas that the curing energy would not reach. This situation would result in portions of the fastener element being under-cured and is undesired.

Figure 23B:
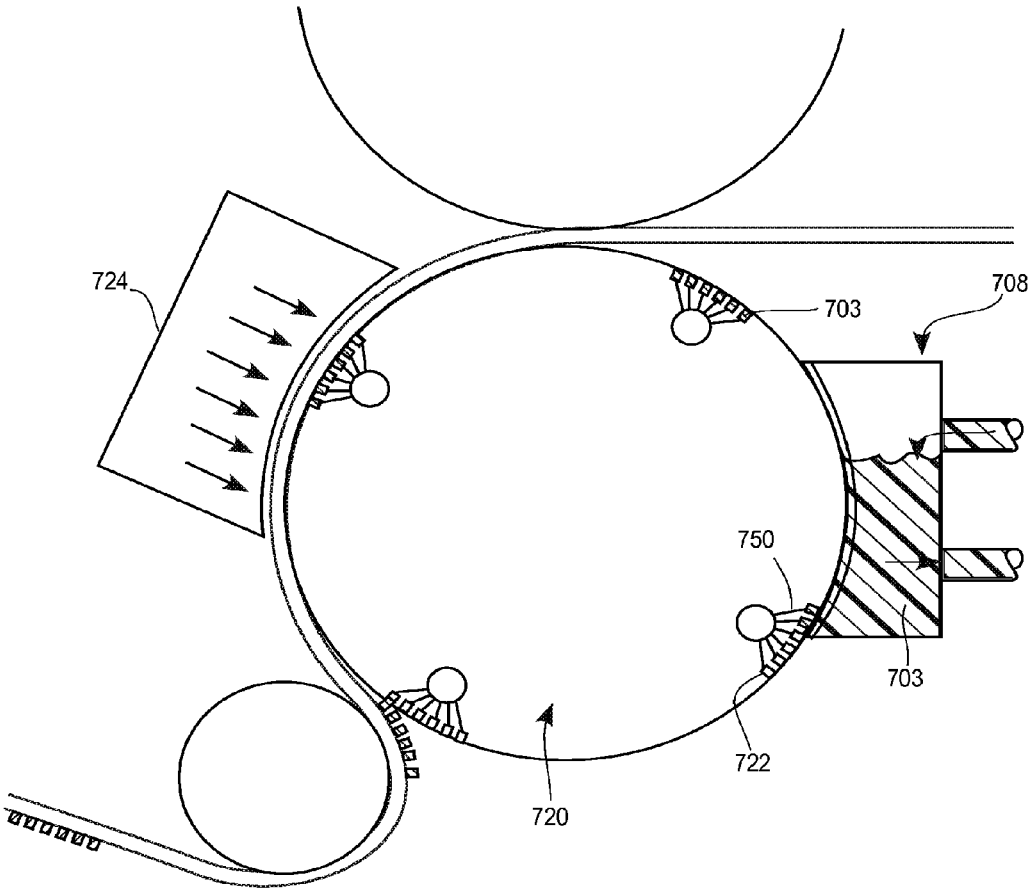
Figure 23C:
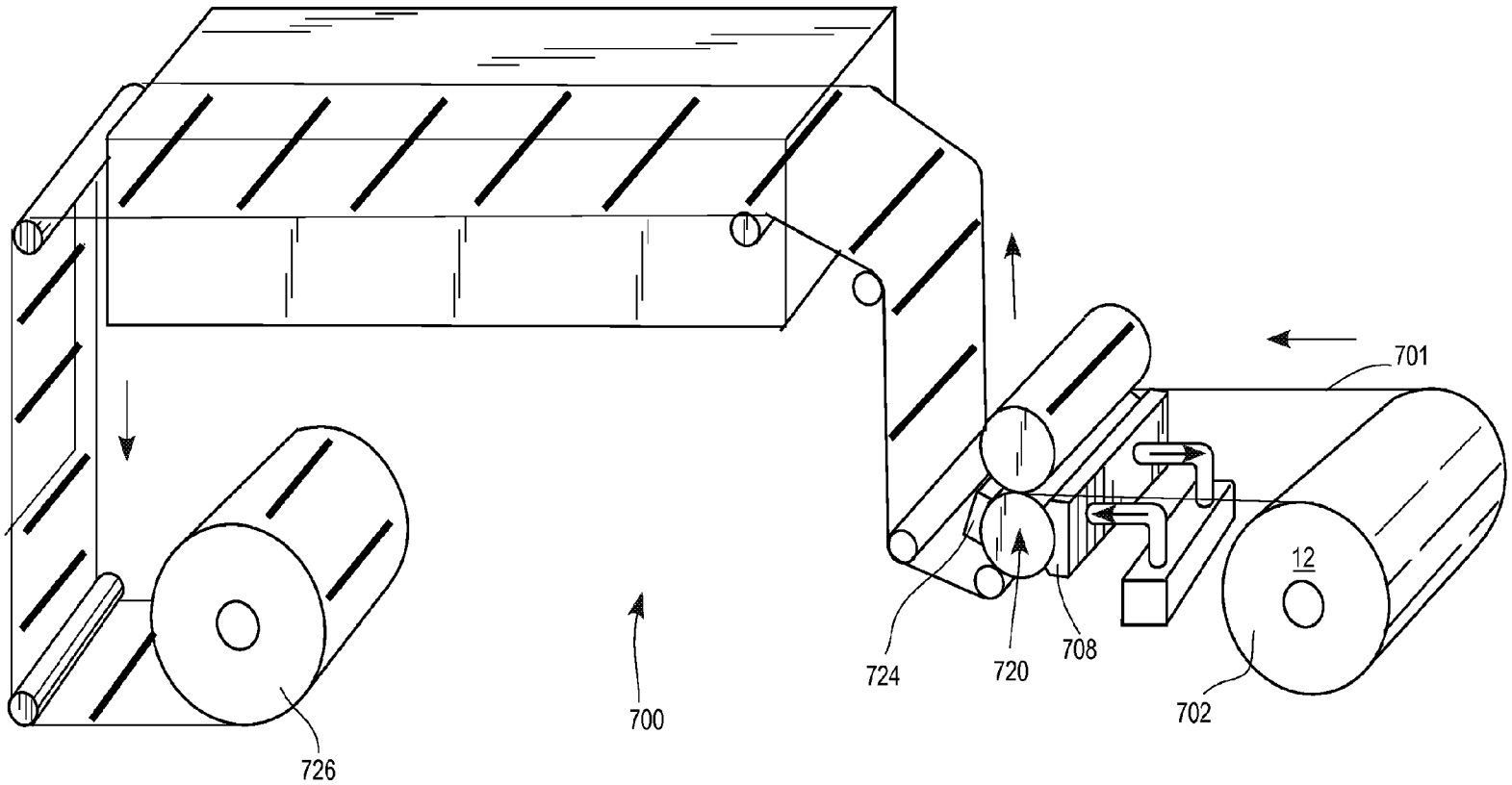

After the adhesive coated substrate advances past the energy source 724, the adhesive is sufficiently cured to form the mating portions 14. Then, the cured adhesive and formed mating portion 14 is released from the mold 720 at position C. The small roller 721*a* is provided adjacent the mold so that the film turns at an abrupt angle in order to remove the portions 14 out of the mold. Because of the surface features of the cured adhesive forming the undercut profiles, they can be difficult to extract from the mold cavities without damaging the formed material. In some approaches, to facilitate removal of the cured and formed molded profile from the mold cavity 722, the mold or at least an outer covering applied to the mold defining the cavities may be formed of or constructed out of a resilient and flexible material, instead of a rigid metal, so that at least the undercut portions 723 of the mold can resiliently flex, bend, or shift to allow the cured adhesive and coupling parts to be released from the mold without damage. This is exemplified at position D shown in FIG. 23. The cured mating portion 727 is then released from the mold intact to form the various mating portions described previously. Another exemplary process is shown in FIGS. 23A and 23B. In this approach, the liquid adhesive is applied directly to the mold for application to the film. In these approaches, the roll-mold may have a skin or outer layer made from resilient high temperature elastomers (such as Viton® or Kalrez®). The adhesive 703 may be applied via a chambered pressurized doctor blade system 708. FIG. 23C shows an exemplary process 700 using the applicator 708 from FIGS. 23A and 23B.

The mold 720 may be entirely constructed from and/or at least include an outer layer constructed from a flexible and resilient material. This material by be a high temperature elastomer. By one approach, suitable high temperature elastomers may be a cured silicone material (such as KE 1300T mold making silicone, an organopolysiloxane mixture from Shin-Etsu Chemical Company, Tokyo.) or a DuPont Vamac®, or Viton®, may be used. Such material is effective to allow the under-cut features, such as mushroom or bulb-shaped protrusions as well as the others, to be more easily extracted from the cavity after curing, because the mold can flex or distort under stress. Also these materials may be more transparent to UV or electron beam energy, preventing shadowing and under-cure in undercut zones within the mold cavities. These materials may have a hardness of about 40 to about 100 Shore A, a tensile strength of about 800 to about 1000 psi, a tear strength of about 100 to about 150 ppi, an elongation of about 350 to about 450 percent, and a linear shrinkage of less than about 0.10%. DuPont Viton® is another example of an elastomeric material that has suitable properties for such a mold. It is flexible enough, having a typical hardness range of about 60-95 durometer, Shore A. It is reasonably transparent to various forms of radiation, and it has an upper temperature limit of 200° C.-210° C.

Optionally, a pressurized enclosed applicator may be employed as well as mold cavity venting to help ensure complete filling of the mold cavities with the uncured liquid adhesive as generally shown in FIGS. 23A and 23B. By one approach, a pressurized application with venting can be provided as a plurality of micro-scale channels to enable trapped air to escape from each mold cavity 722. Examples of these optional channels are shown in FIGS. 23, 23A, and 23B with at least one vent channel 750 associated with each mold cavity 722 (in FIG. 23 only one of the cavities is shown with this optional feature). The vent channel 750 may be associated with a vacuum or other suction to pull negative pressure on the mold cavity. By one approach, the vacuum can be applied to the mold at an end opposite the opening to the mold cavity to draw in the adhesive portion into the cavity of the mold. A vacuum in the range of about 10 to about 25 inches Hg can be applied.

FIG. 23B generally shows an optional method of forming the fastener when it has no interfering or undercut surfaces. In this approach, the fastener portions generally have straight side walls. The mold may be rigid and opaque to UV light.

By one approach, a UV photoinitiator can be added to the uncured, liquid adhesive to aid in initiating the curing process when curing via application of UV energy. The photoinitiator can be present in amounts of about 0.1% to about 5%. In one aspect, a photoinitiator can comprise a blend of benzophenone derivatives and a synergist compound. A synergist compound is a compound that interacts with the excited benzophenone molecules to form free radicals by electron transfer and hydrogen abstraction. One example is a mixture comprising trimethylbenzoyldiphenylphosphine oxide, α-hydroxyketones and benzophenone derivatives, where the synergist compound includes the first two compounds listed. In another example, the photoinitiator is α-hydroxyketone by itself. In another aspect, a photoinitiator can comprise onium salts or other acidic materials activated by UV light.

By one approach, a photoinitiator comprising a blend of benzophenone derivatives and a synergist compound can be used in the coating formulation, which can result in the formation of free radicals. In free radical initiated polymerization systems, the curing reaction stops at the moment the UV energy source is withdrawn. An alternative mechanism for UV curing is cationic initiated polymerization. Cationic initiated polymerization systems, which use photoinitiators, such as onium salts or other UV activated acid catalysts to crosslink epoxides or vinyl esters, differ from free radical initiated systems in that the curing reaction continues even after the source of UV energy is withdrawn.

Figure 24:
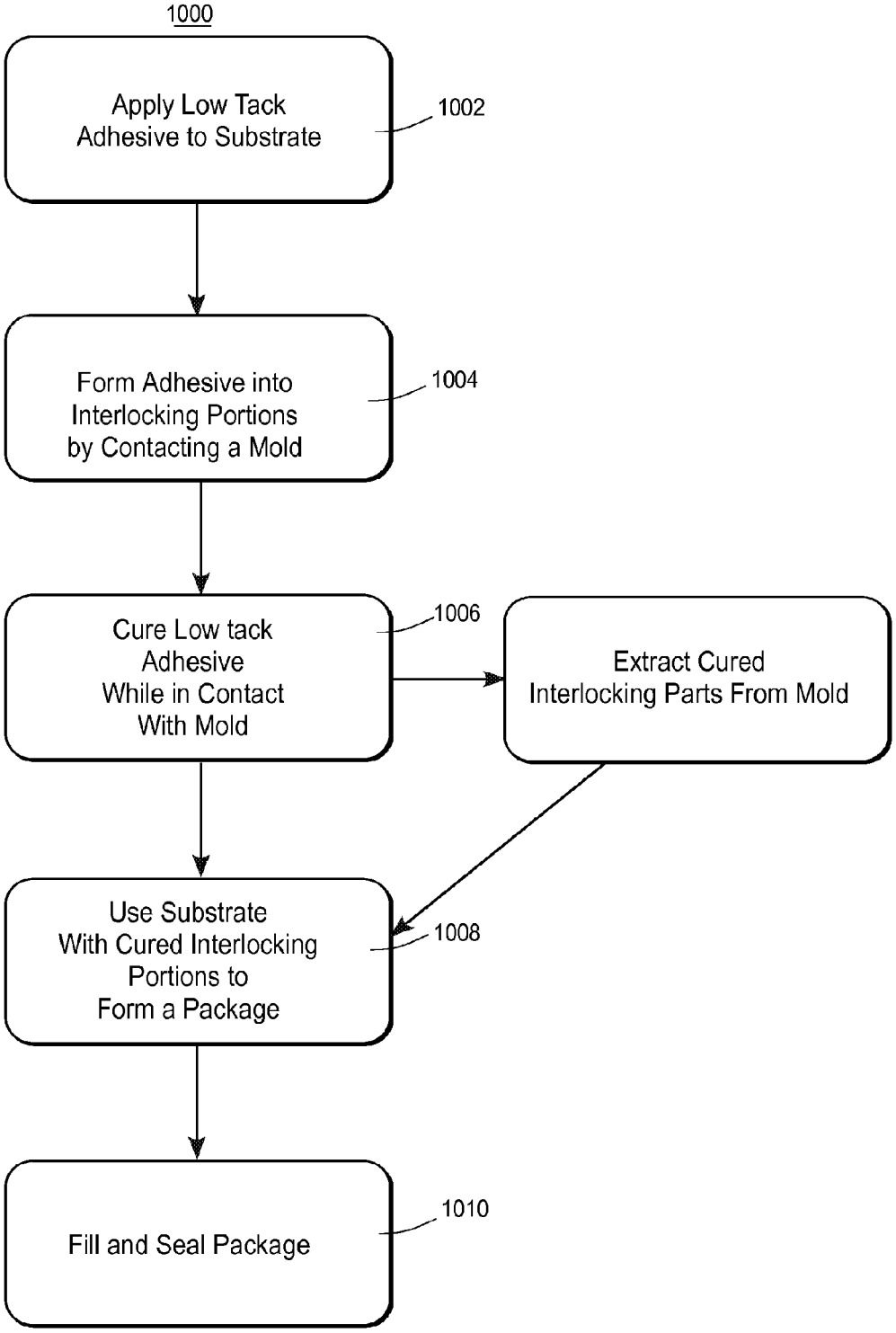
FIGS. 24, 24A, and 25 are exemplary processes to prepare packages with the adhesive-based reclosable fastener.

In some aspects, a package can be created in accordance with a method 1000 and/or a method 2000 as generally shown in FIGS. 22, 22A, and 23, and/or method 1001 as shown in FIGS. 23A, 23B, and 23C. By one approach, as generally shown in FIG. 24, the low tack adhesive, configured as described above, is applied 1002 to a package substrate in a suitable pattern to dispose the adhesive-based fastener 12 thereon. The low tack adhesive is then formed into mating portions 1004 through contact with a patterned flexible mold. If the fastener is the non-interference embodiment, then the mold may be rigid. While in contact with the mold, the low tack adhesive is then cured 1006, such as, for example, by UV-curing or electron beam energy curing on the package substrate. Once the adhesive-based fastener 10 is applied and cured, the package substrate can be formed 1008 into the particular construction of the package, which can take any suitable form. Once formed, the package can then be filled 1010 with a product if so desired. Alternatively, the package can, in some instances, be formed first and have the adhesive applied thereon. Process 1000 is generally consistent with FIGS. 22, 22A, and 23, for instance.

Figure 24A:
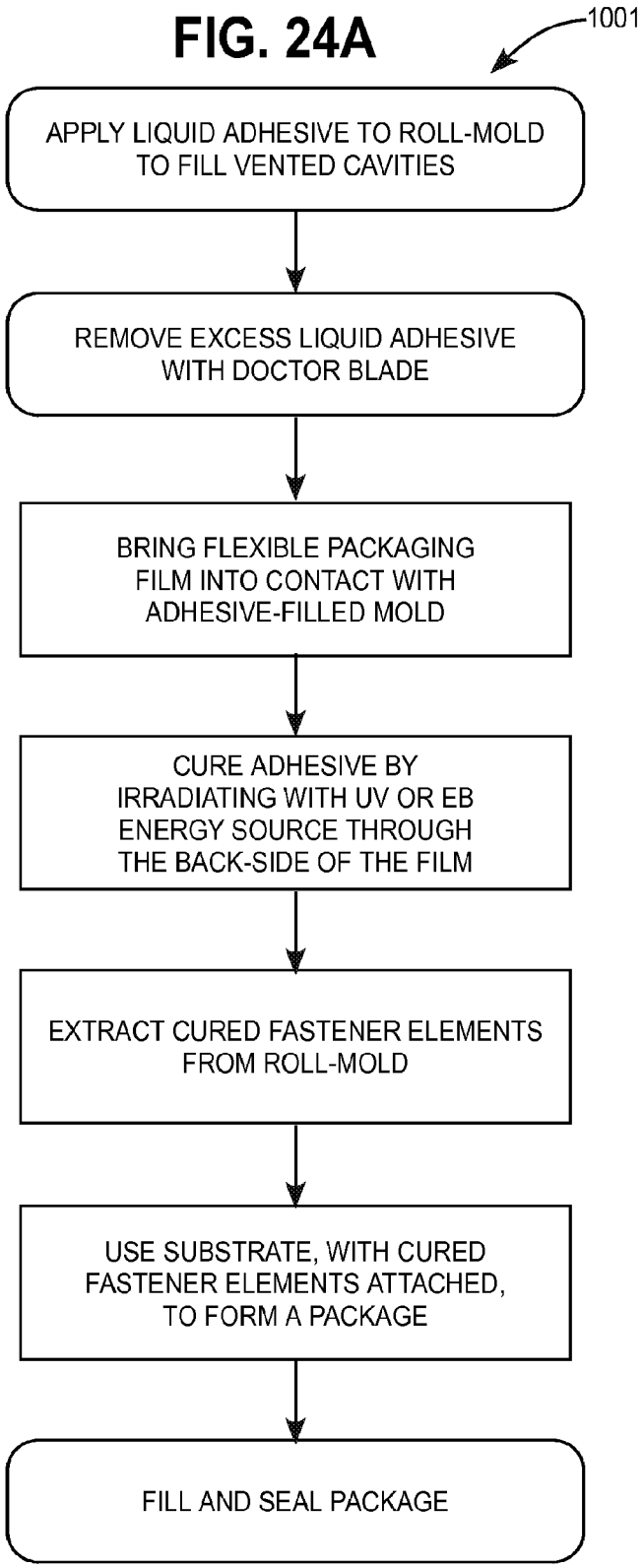

As shown in FIG. 24A, a process 1001 may first apply a liquid or flowable adhesive to a roll-mold to fill the vented cavities. Then, excess liquid adhesive is removed with a doctor blade. A film or other substrate is then brought into contact with the adhesive filled mold. As the substrate is in contact with the roll-mold, the adhesive is then cured by irradiating with UV or EB energy through the back side of the substrate. Next, the cured fastener elements are removed from the mold. This process is generally consistent with FIGS. 23A, 23B, and 23C, for instance.

Figure 25:
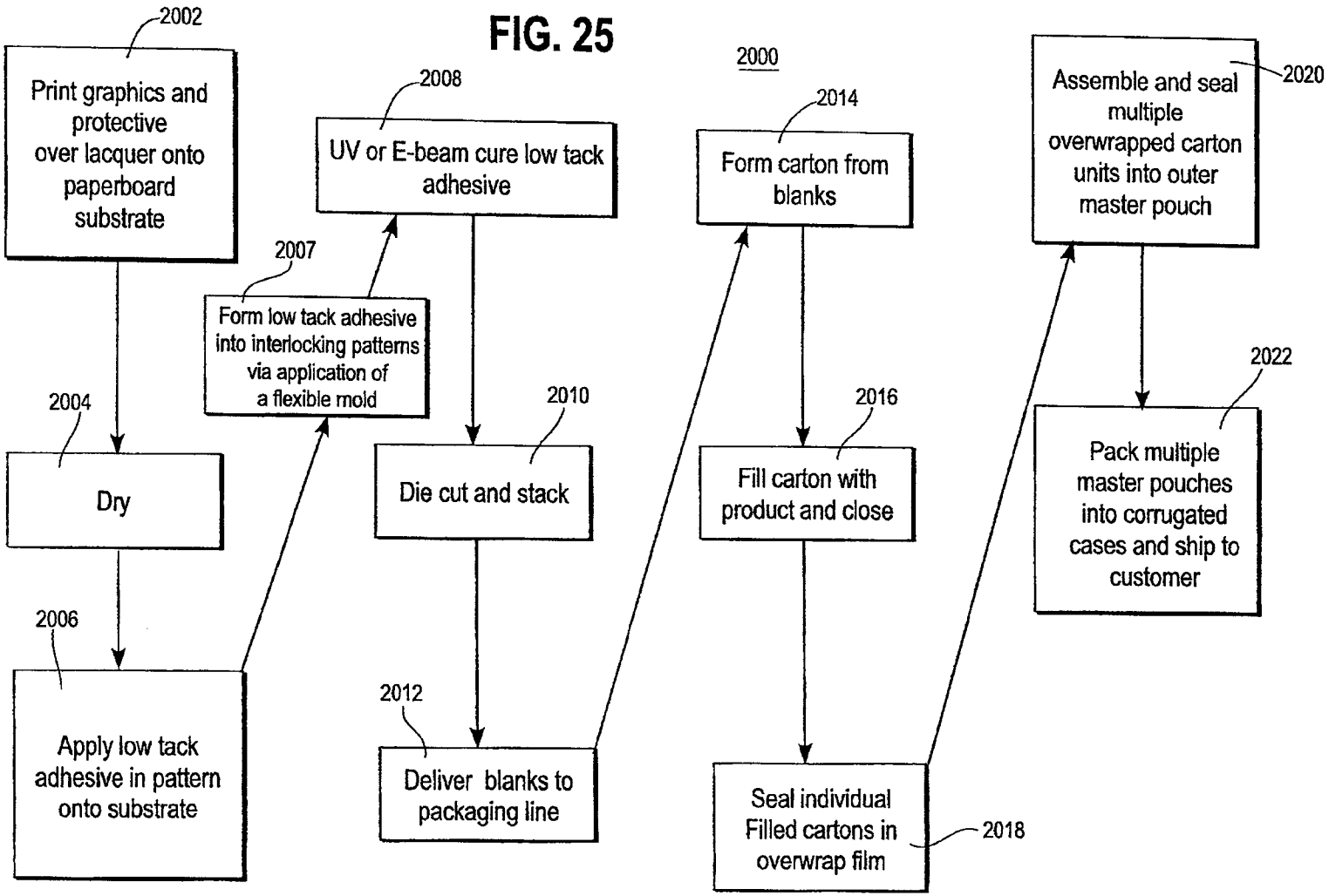

By another approach, as shown in FIG. 25, a method 2000 of preparing a package substrate, which may be suitable for forming a more rigid package, is shown. First, graphics, coatings, layers, and/or alphanumeric content may be printed or otherwise applied 2002 on various inner or outer surfaces of the package substrate, which can be paperboard or the like. This can also include printing 2002 an overlacquer, a polymer coating, or the like onto the package substrate as described above. The overlacquer or coating may include the filler as described above if needed to enhance bonding of the adhesive to the package. This application can be done via any suitable process, including a coating, flexo process, extrusion die, or a gravure process, for example. The printing and/or coating is then allowed to dry 2004 so that the low tack adhesive, such as that discussed above, can be applied 2006 to the substrate by a suitable process, such as a coating, flexo process, extrusion die, or a gravure process and the like. The low tack adhesive is then formed 2007 into mating portions via application of a flexible mold. The low tack adhesive is then cured 2008 while in contact with the patterned flexible mold to form the adhesive-based reclosable fastener having a patterned surface structure corresponding to the patterns of the flexible mold. If the substrate is opaque, the UV or electronic beam energy source can be located within the flexible transparent roll-mold. After curing, the package substrate is then cut 2010 into one or more blanks or other package structure by any suitable device, such as one or more dies, rotary dies, lasers, etc., and stored for future use. When use is desired, the blanks are delivered 2012 to the packaging line. Alternatively, the blanks can be formed in-line with the packaging line. On the packaging line, the desired package form is created 2014 by folding the blanks about the various fold lines, applying permanent adhesive at overlapping portions, and adhering the overlapping portions together. Once the package is created, they can then be filled 2016 with one or more products, such as food products, and closed for storage, shipping, and display. The filled packages are then wrapped 2018 in a clear overwrap film and assembled and sealed 2020 with other wrapped packages in an outer master pouch or package. Multiple outer master pouches or packages are packed 2022 into one or more cases and shipped to a customer, retail store, or the like. Alternatively, the low tack adhesive may be applied later in the process, such as after the die cut step 2010, after the forming step 2014, and/or after the filling step 2018 as needed for a particular application. In this approach and when the substrate is opaque, the energy source generally will need to be inside the roll-mold (i.e., roll-mold 720 for instance) and the roll-mold itself will be transparent, translucent, or otherwise capable of transmitting UV or E-beam energy to the adhesive in the various mold cavities.

Turning now to FIGS. 26 to 29, other embodiments of a hybrid reclosable fastener are shown. The fastener in these approaches is similar to the previous approaches in many aspects, but the fasteners in these alternative approaches define a non-interference mechanical coupling and do not include or define overlapping or undercut surfaces. In these approaches, the fasteners define profiled surfaces including adhesive fastening elements that exhibit a shear force and, in some cases, both a shear and a peel force upon opening or separation of fastener portions. Thus, when a force is applied to separate the joined fastener elements, the geometric design of the fastener causes forces to act in a shear mode (and in some cases also a peel mode). As used herein, shear mode generally means that the direction of the applied force is generally along or parallel to the plane of bonded surfaces (see, e.g., FIG. 28), and a peel mode generally means that the direction of the applied force is generally transverse and in some cases generally perpendicular to the plane of bonded surfaces (see, e.g., FIG. 29). By one approach, this type of fastener is achieved by having coupling elements with straight abutting surfaces that extend outwardly away from the base of the opposite fastener portions.

In these alternative approaches, the coupling elements of the fastener can have generally straight side-walls that abut or fit closely together when fastener portions are coupled, but the coupling elements have minimal to no under-cut surfaces or portions. The close contact between the surfaces of the joined elements is enough for an effective mechanical or frictional attachment. The attachment or bonding of the adhesive surfaces upon coupling is strong, particularly along touching surfaces of the side-walls, because of the geometry of this system and the shear forces that are needed to be overcome to separate abutting surfaces. In other words, when a force is applied to separate the joined elements, the geometric design and shape of the coupled fastener causes forces to predominately act in a shear mode along the straight side walls and, in some cases, in a peel mode along ends of the fastener.

As shown in FIGS. 26 to 29, the fastener may include protruding fastening elements with linear or straight side edges. The protruding straight-sided coupling elements, and corresponding straight-sided cavities, are effectively spaced and sized such that the smooth side walls are in abutting contact when engaged (see, e.g., FIG. 26B). This arrangement is effective to create a broad contacting surface area where the sidewalls are able to become adhesively connected. With this approach and depending on the size of the protuberances, the dominant forces acting on the adhesive/adhesive bond between the side walls during opening or separation may be shear forces. It is anticipated that separation of the coupled fastening elements with a shear mode along an adhesive/adhesive bond requires more force than separating similarly bonded surfaces via normal forces (i.e. forces acting perpendicular to the bond line or plane of separation). Therefore, it is anticipated that a fastener system utilizing straight-sided pegs or ridges as coupling elements, where the pegs or ridges are made from or are covered with a self-bonding adhesive material, will result in reclosable fastener having a higher bonding strength as compared to two flat surfaces joined by an adhesive coating (compare FIG. 28 to FIG. 29).

By one approach, the fastener generally includes or defines a closure that has both mechanical and adhesive mating elements defined on the same fastener component to maintain the closure in a closed position. The adhesive elements are effective and configured to exhibit shear and, in some cases, both shear and peel forces upon peeling the fastening components apart. In another approach, the mechanical closure generally defines closure surfaces that are at least partially or completely covered or coated with a bonding or adhesive material that is anticipated to improve the peel strength of the closure by at least about 20 percent over the peel strength of the same fastener geometry without the applied adhesive. In other approaches, the closure has two opposing sides which are peelable and resealable and the opposing sides are maintained in direct contact by a combination of mechanical and adhesive mating. The mechanical mating may include contours on each of the opposing sides which interact with each other to create a mechanical resistance to separation without interfering or undercut surfaces, and the adhesive mating is composed of adhesive materials that are peelable and resealable between two opposing and abutting planar surfaces. In yet another approach, the fastener includes coupling elements made with or includes a bondable or adhesive material. The coupling elements have no undercutting or interference upon engagement. However, the coupling elements do include contacting surfaces which are oriented substantially perpendicular to the plane of the joined surfaces, and, the perpendicular orientation of the contacting surfaces, when engaged, are separated mainly by shear forces and in some cases frictional forces as well as shear forces.

Figure 26A:
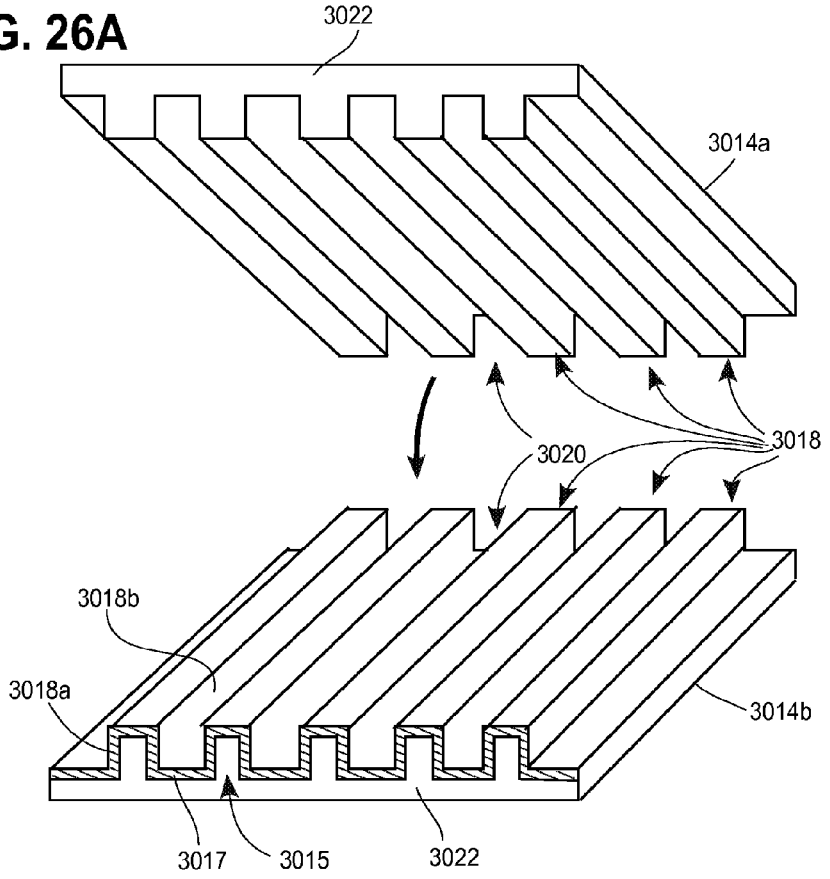
FIGS. 26A and 26B show an exemplary adhesive based reclosable fastener with non-interference coupling portions.
Figure 26B:
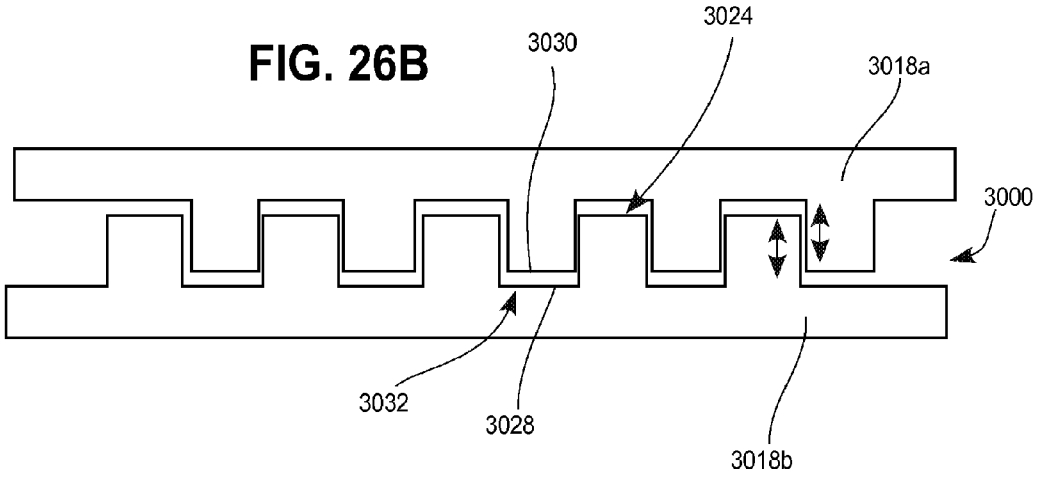

Turning to more of the specifics of these non-interference embodiments, FIGS. 26A and 26B illustrate a first approach of a non-interference-type fastener 3000 with both mechanical and adhesive mating elements. The fastener 3000 includes opposing fastener portions 3014 defining mating portions 3014*a* and 3014*b* on each of the opposing portions. The mating portions 3014*a* and 3014*b* are configured and at least partially formed out of a material to provide both mechanical and adhesive mating of the fastener. By one approach, the mating portions 3014 are constructed from a non-adhesive foundation or base 3015 defining the geometry and shape of the fastener 3000 and coated or covered with a layer of a bondable or adhesive material 3017 on at least outer surface portions thereof (or the entire outer surfaces) of the fastener 3000. By another approach, the entire fastener 3000 may be constructed out of a bondable or adhesive material. The fastener 3000 may be a solid material that is devoid of internal spaces or cavities. The bondable material or adhesive may be the previously described adhesive or may be other types of adhesive as needed for a particular application.

In this approach, each of the mating portions 3014*a* and 3014*b* define protruding ribs or ridges 3018 that extend in rows about the fastener. The number or rows shown is only exemplary and may include more or less as needed for a particular application. Between adjacent rows 3018 there is defined a cavity 3020 sized and configured to receive a rib or ridge 3018 from the opposite fastener portion as shown in FIG. 26B when the fastener is coupled or mated together.

Each of the ribs 3018 has side walls 3018*a* and 3018*b* with a generally straight or linear shape, profile, or contour. In one form, opposing side walls 3018 are generally parallel to each other and extend outwardly, by one approach, in a substantially perpendicular manner from a base 3022 of the fastener. When the fastener portions are coupled together, these linear or straight side walls are configured to closely abut each other or contact each other to provide a non-interference mechanical coupling and also provide adhesive contacting portions along the side walls that result in the shear forces upon pulling the fastener portions apart (see FIG. 28). For example, the contacting adhesive 3024 on abutting side walls separates via a shear mode when the fastener portions are pulled part (FIG. 26B). In addition, if bottom portion 3028 of one cavity 3020 contacts the top portion 3030 of a coupled rib (FIG. 26B), then the fastener may also exhibit a peel force 3032 between these two contacting surfaces upon opening. In this situation, the fastener 3000 may exhibit both a shear and a peel force upon opening.

Figure 27A:
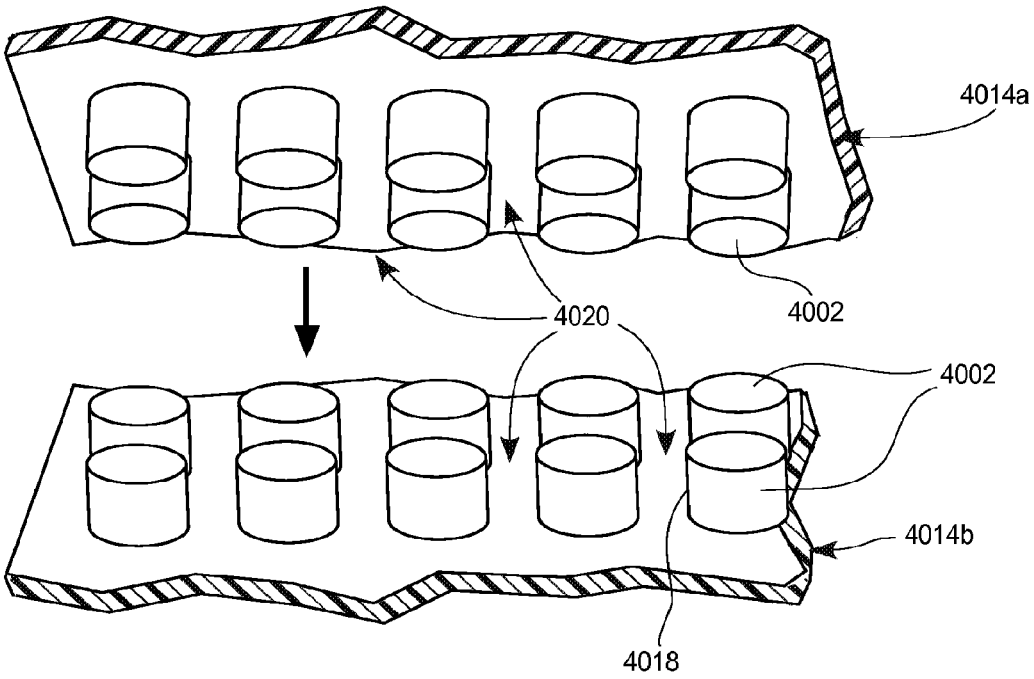
FIGS. 27A and 27B show another exemplary adhesive based reclosable fastener with non-interference coupling portions.
Figure 27B:
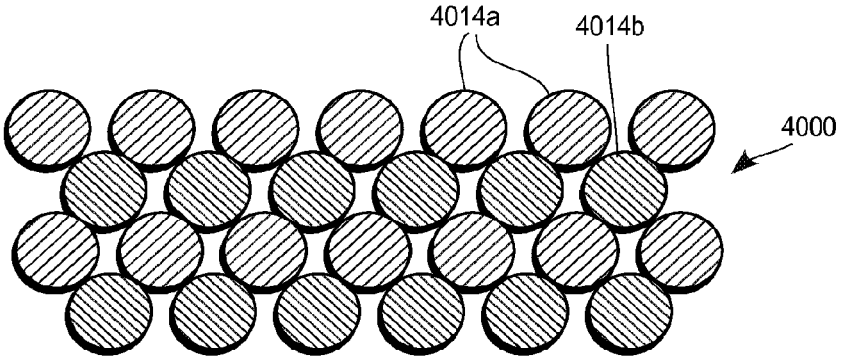

FIGS. 27A and 27B show an alternative version of a non-interference hybrid fastener 4000. In this approach, the mating portions are a plurality of pegs or protruding posts 4002 that define a cavity 4020 between one or more adjacent pegs or posts 4002. This fastener 4000 is similar to the fastener 3000 and may include a non-adhesive base or foundation with a layer of adhesive covering all or portions of the fastener, or the entire fastener itself may be constructed out of a bondable or adhesive material. Again, the previously described adhesive or other types of adhesive may be used for this fastener as well. While the posts 4002 are shown as cylinders, they may take on other shapes as needed for a particular application. To define a non-interference fit, each post 4002 has generally straight or linear side walls 4018 that extend away, in one approach, perpendicular to a base of the fastener. FIG. 27B illustrates the opposing fastener portions 4014*a* and 4014*b* coupled together.

Figure 28:
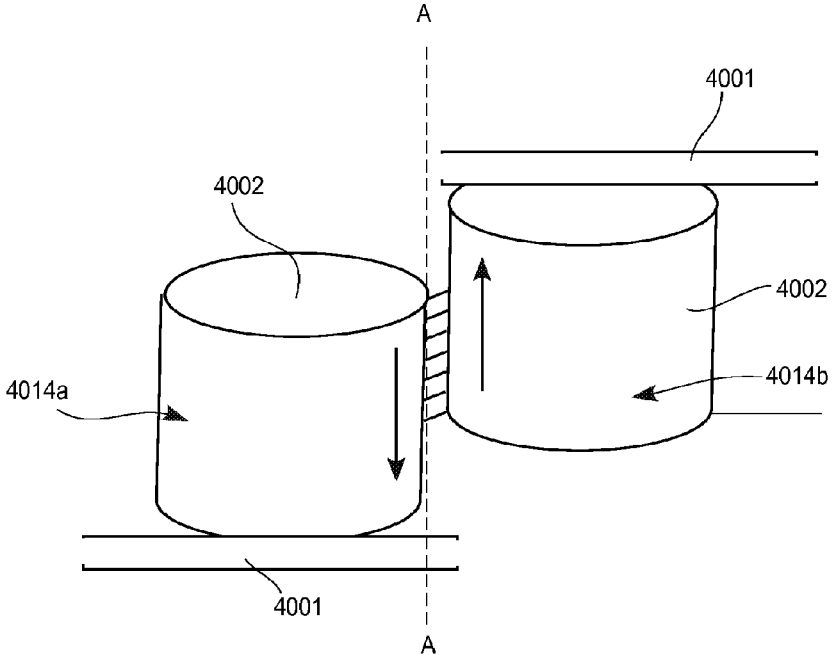

FIG. 28 illustrates an exemplary separation of the fastener from FIG. 27 showing that forces acting parallel to the bond line A dominate and tend to result in a higher shear force than any peel forces. That is, there is a high separation force between 4014*a* and 4014*b*. The fastener of FIG. 26 would function in a similar manner. Here, the bond line A is generally transverse and in some cases generally perpendicular to any substrate that the fastener is applied to. This type of separation occurs between the side walls 3018 or 4018 of the fastener upon opening.

Figure 29:
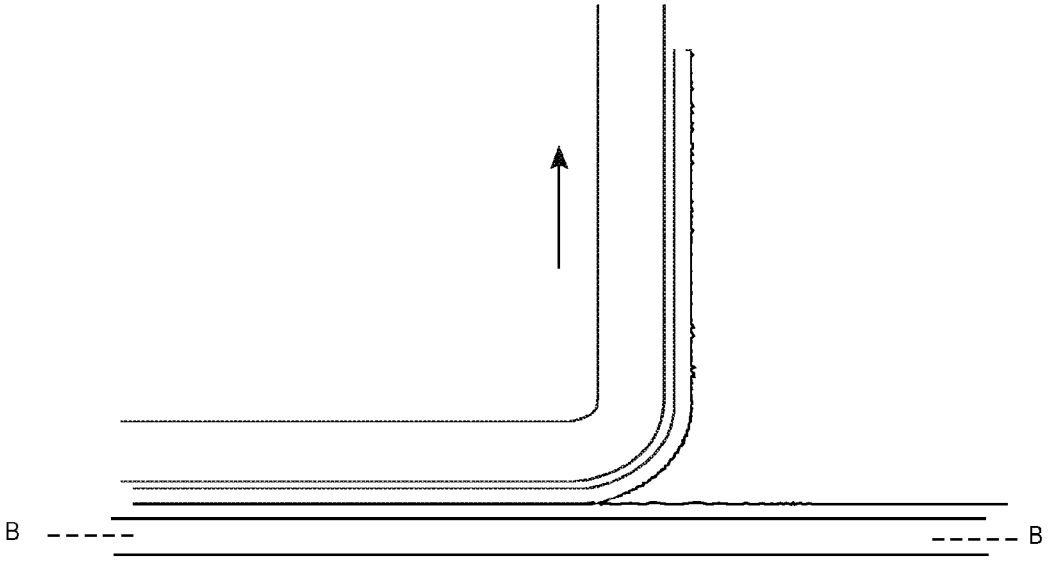
FIGS. 28 and 29 compare shear forces upon opening to peel forces upon opening of fasteners herein.

On the other hand, FIG. 29 shows the peel forces that tend to dominate when two flat surfaces are peeled apart generally perpendicular to a bond line B. Here, a relatively low separation force would result. In some cases, this type of separation occurs between the base of a cavity and the top surface of a peg or ridge such that the fastener exhibits both peel and shear upon opening.

In some approaches the mating portions may be self-centering. In such approach, the mating portions may be conical shaped, which may enable a self-centering of the fastener mating portions upon fastening. The mating portions may also have wavy surfaces.

Advantages and embodiments of the patterned fastener and package described herein are further illustrated by the following examples; however, the particular conditions, processing schemes, materials, and amounts thereof recited in these examples, as well as other conditions and details, should not be construed to unduly limit the patterned fastener, package, and methods. All percentages are by weight unless otherwise indicated.

EXAMPLES

Example 1

Figure 30:
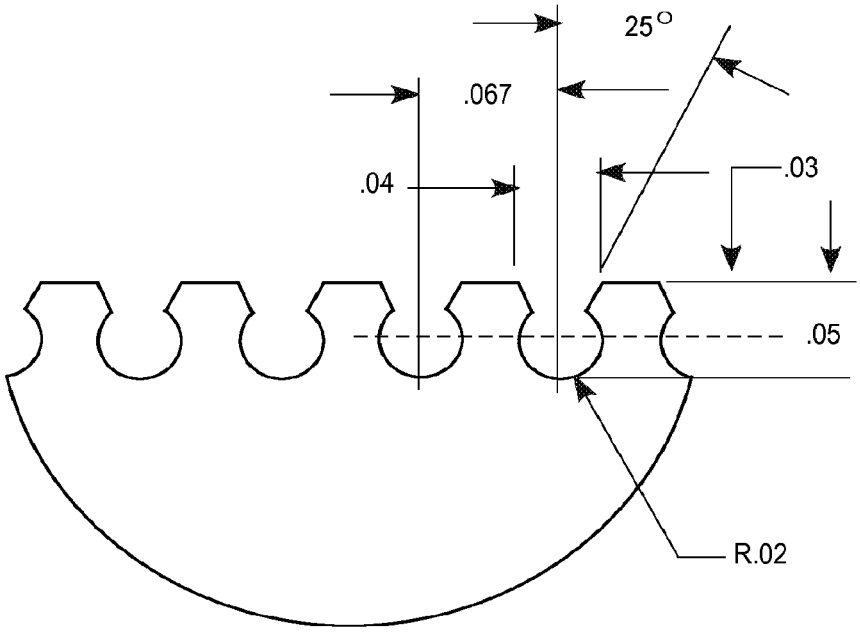
FIG. 30 is a cross-sectional view of an exemplary mating closure referred to in some of the Examples.

An adhesive including about 35% epoxidized soy bean oil acrylate (Sartomer CN111US), about 12 percent methacrylated polybutadiene (Cray Valley Ricacryl 3500), about 50% aliphatic urethane acrylate oligomer (Sartomer CN3211), and about 3% photoinitiator (Lamberti Esacure KTO 46) were mixed to form a low tack adhesive. This adhesive had an adhesive component ratio of 0.56. This adhesive was then formed into a mating closure having a uni-directional system with mating portions, as shown in FIGS. 3-6. Forming the closure was accomplished by applying the wet adhesive to a flexible film substrate, contacting the adhesive with a flexible mold, and curing by irradiating with UV energy from the film side (i.e., the side opposite the adhesive). The sample was coupled, as shown in FIGS. 5 and 6, and the peel strength to separate the coupled and adhered opposing layers was then tested on an Instron machine for measuring peel force. The sample was then reclosed and opened again. This test was repeated for a total of three times. The results are provided below in Table 1, where sample A-1 indicates the patterned reclosable fastener sample. The image of FIG. 30 generally shows the shape of the mating closure used for this Example with approximate dimensions in inches.

Subsequently, one side of the fastener was then contacted with roast and ground coffee. The surface was covered with an excess of roast and ground coffee for about 30 seconds, the excess was shaken off and the sample was resealed and tested on the Instron for peel strength. The coffee was Starbucks House Blend, Medium, Roast, and Ground Coffee. The size distribution was characterized as follows:

| | Ground Coffee | |
|---|---|---|
| Total Sifted (g) | 100.06 | |
| | weight (g) | % weight |
| >600 micron | 67.03 | 68.8 |
| 425-600 micron | 13.52 | 13.9 |
| 250-425 micron | 8.61 | 8.8 |
| <250 micron | 8.3 | 8.5 |
| Sum | 97.46 | 100 |
| Loss | 2.6 | |

Excess coffee was shaken off the surface and the sample was resealed and then opened and tested on the Instron for peel strength. The sample was re-exposed to coffee and resealed and tested for a total of three times. The results are provided below in Table 1, shown as sample A-2 with ground coffee.

Sample A-2 with ground coffee contamination showed a slight reduction in average peel strength of about 71.7 g/in compared to about 96.2 g/in for the uncontaminated sample. It should be noted that when sample A-2 was resealed after contact with ground coffee, the subjective feel of the seal mating was the same as before exposure to ground coffee. Notably, the ground coffee particles that remained on the surface of sample A-2 were mostly on the top of the mating ribs, not between the ribs. Table 1 below summarizes the peel strength data generated.

TABLE 1

Peel Strength Values

| Sample | Trial Run | Peel Strength (g/in) | Average Peel Strength (g/in) |
|---|---|---|---|
| A-1 | 1 | 90.4 | 96.2 |
| | 2 | 98.5 | |
| | 3 | 99.7 | |
| A-2 w/Ground Coffee | 1 | 66.3 | 71.7 |
| | 2 | 69.6 | |
| | 3 | 79.3 | |

The fastener sample A-1 was also exposed to slices of Oscar Mayer smoked ham (Kraft Foods), and the reseal performance was observed to be the same as an uncontaminated sample.

As comparison, the same adhesive in a non-patterned or flat/smooth fastener was also tested. In this comparison, the adhesive sample was contacted with in one case roast and ground coffee and in another case a slice of Oscar Mayer Deli Fresh Brown Sugar Ham, by covering it with an excess amount of food product and leaving it in contact with the film sample for 2 to 3 minutes. The samples were lifted and gently shaken to remove the food. The ham left behind visible evidence of significant moisture on the surface of the adhesive-coated film. In the case of the samples exposed to coffee, fine particulates were visible on the surface. Then, the contaminated film samples were placed (by hand) against uncontaminated samples of the same adhesive. Instron peels could not be performed because there was no adhesion in the contaminated areas.

Example 2

The following is an Instron test procedure used to measure peel forces between the fasteners described herein. First, place an Instron Peel Test sled in to the Instron. Place the test panel onto the test sled and lock into place with the thumb screws. Adjust the sled and crosshead (with small grip installed) so that the grip is approximately 1.5" from the surface of the panel. Next, place the free end of the peel strip into the grip so that the strip is locked in the grip as close to about 90° as possible. This angle is not controlled and is determined by the properties and geometry of the mating test strip (rigidity, thickness, coupling design, etc.) "Zero" the grip distance and load on the Instron.

Figure 31:
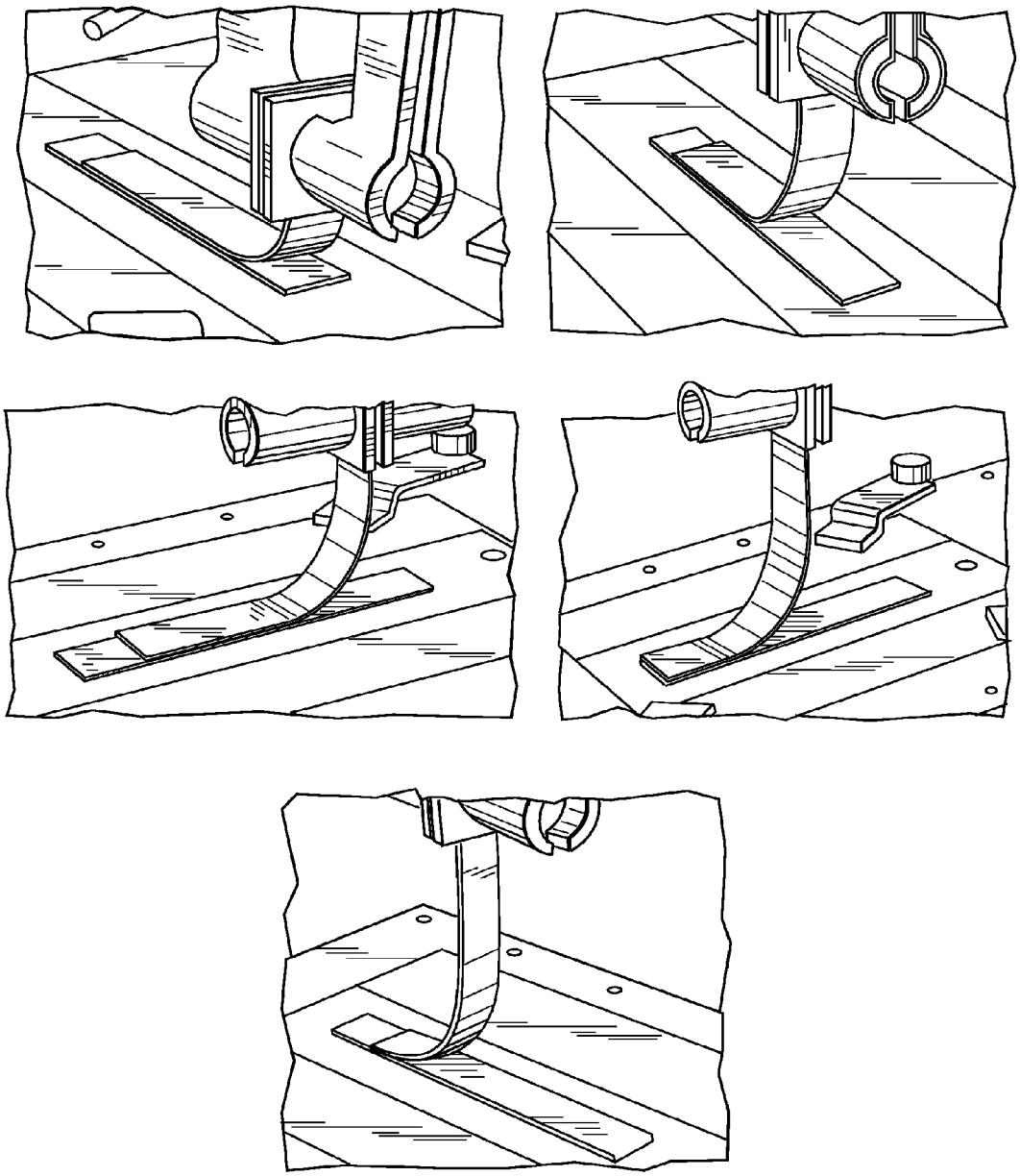
FIG. 31 are images of Instron tests for some of the Examples.

Then, begin the Instron test with crosshead speed set to 12.0 in/min. Manually stop the test when the peel strip is approximately 0.25" from the end. Set the data collection so that the average peel strength is collected by averaging the 5 high peaks and 5 low values over a test area of 3 inches. Output data desired is "Average load/width at Average Value (5 peaks+Troughs)". Images of the test are provided in FIG. 31.

It will be understood that various changes in the details, materials, and arrangements of the fastener and process of formation thereof, which have been herein described and illustrated in order to explain the nature of the described materials, may be made by those skilled in the art within the principle and scope of the embodied method as expressed in the appended claims.

What is claimed is:

1. A combined mechanical mating and adhesive-based reclosable fastener comprising:

opposing substrate portions for supporting the reclosable fastener; mechanically mating elements of the reclosable fastener including mating portions having cooperating coupling parts configured to provide mechanical mating of the fastener when the cooperating coupling parts are coupled together;

adhesive mating elements of the mating portions including contacting portions of the cooperating coupling parts formed of an adhesive material exhibiting a bond between the contacting portions configured to provide an adhesive mating of the cooperating coupling parts when coupled together;

the mechanically mating elements and the adhesive mating elements combine to provide a first peel force between the opposing substrate portions of about 80 to about 900 grams per linear inch (gpli) and up to five subsequent peels between the opposing substrate portions of about 60 to about 900 grams per linear inch (gpli); and wherein each of the cooperating coupling parts define mating undercut surfaces for providing the mechanical mating from an interference engagement therebetween effective to provide a total mating force between the mating portions of the fastener from both the mechanical mating and the adhesive mating thereof from about 80 to about 900 grams per linear inch (gpli).

2. The fastener of claim 1, wherein the cooperating coupling parts of the fastener are formed from an acrylic adhesive having at least one energy-curable acrylic oligomer, at least one tack control component, and optionally at least one elastomeric material.

3. The fastener of claim 2, wherein the acrylic adhesive has an Adhesive Component Ratio (ACR) defined by formula (A) where a weight percent of the energy-curable acrylic oligomer relative to a sum of the weight percents of the tack control component and the elastomeric material is about 0.5 to about 1.5

$$\frac{(\text{wt \% UV-curable acrylic oligomer})}{(\text{wt \% tack control component} + \text{wt \% elastomeric material})}, \quad \text{(A)}$$

the ACR effective so that an energy-cured adhesive has an adhesive mating force exhibiting a first peel adhesion between the contacting portions of the cooperating coupling parts of about 80 to about 900 grams per linear inch (gpli) and up to five subsequent peel adhesions between the opposing pressure sensitive adhesive layers each about 30 to about 200 percent of the first peel adhesion.

4. The fastener of claim 2, wherein the cohesive material forming the contacting portions of the cooperating coupling parts exhibits a rolling ball tack between about 4 to about 14 inches.

5. The fastener of claim 3, wherein a mold used to form the cooperating coupling parts is transparent such that at least about 50 percent of the curing radiation is transmitted through a mold material to a depth equal to the height of the coupling elements.

6. The fastener of claim 1, wherein a peel force between the mating portions of the fastener has a mating peel force contribution from the mechanical mating and a mating peel force contribution from the adhesive mating.

7. The fastener of claim 1, wherein the cooperating coupling parts include a tongue on one mating portion and a complementary groove on the other mating portion.

8. The fastener of claim 1, wherein the cooperating coupling parts include a plurality of spaced mating protrusions on each of the mating portions.

9. The fastener of claim 8, wherein each of the plurality of mating protrusions includes a post and an enlarged portion at a distal end of the post.

10. The fastener of claim 1, wherein the opposing substrate portions include a flexible film having adhesion promoting particles dispersed throughout at least at an interface between the flexible film and the mating fastener portions effective to promote a bond between the mating fastener portions and the substrate greater than a peel force between the mating fastener portions.

11. The fastener of claim 10, wherein the adhesion promoting particles are selected from the group consisting of clay, phillosilicates, calcium carbonate, montmorillonite, dolomite, talc, mica, and mixtures thereof.

12. The fastener of claim 11, wherein the adhesion promoting particles are an organically modified montmorillonite treated with ammonium salt surfactants.

13. The fastener of claim 12, wherein the organically modified montmorillonite is supplied with a maleic anhydride grafted polyethylene carrier effective to disperse the montmorillonite in the film.

14. The fastener of claim 10, wherein the flexible film includes at least a sealant layer on facing inner surfaces of the opposing substrate portions including the adhesion promoting particles and to which each of the mating fastener portions is bonded thereto.

15. The fastener of claim 10, wherein the sealant layer includes a blend of ethylene vinyl acetate (EVA), polyethylene, and a filler composition including the adhesion promoting particles and a polymeric carrier resin.

16. The fastener of claim 3, wherein the acrylic adhesive includes about 1 to about 90 percent of the energy-curable acrylic oligomer, about 1 to about 65 percent of the tack control component, and about 5 to about 20 percent of the elastomeric material.

17. The fastener of claim 3, wherein the mating fastener portions are formed of the acrylic adhesive and the ACR and the opposing substrate portions are effective to form a bond strength of the mating fastener portions to the opposing substrate portions greater than the first and subsequent peel adhesion between the mating fastener portions so that the opposing substrate portions can be repeatedly peeled open without delaminating the mating fastener portions from respective opposing substrate portions.

* * * * *